US006481824B1

(12) United States Patent
Hayakawa et al.

(10) Patent No.: US 6,481,824 B1
(45) Date of Patent: Nov. 19, 2002

(54) INK JET RECORDING APPARATUS AND RECORDING HEAD CLEANING CONTROL METHOD THEREON

(75) Inventors: Hitoshi Hayakawa, Nagano-ken (JP); Tatsuya Seshimo, Nagano-ken (JP); Hikonosuke Uwai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/324,720

(22) Filed: Jun. 3, 1999

Related U.S. Application Data

(63) Continuation-in-part of application No. 09/239,319, filed on Jan. 29, 1999.

(30) Foreign Application Priority Data

| | | |
|---|---|---|
| Jan. 30, 1998 | (JP) | 10-018657 |
| Jun. 3, 1998 | (JP) | 10-18657 |
| Jun. 3, 1998 | (JP) | 10-154852 |
| Jun. 3, 1998 | (JP) | 10-359052 |
| Nov. 30, 1998 | (JP) | 10-339052 |

(51) Int. Cl.[7] ..... B41J 2/165
(52) U.S. Cl. ..... 347/24; 347/30
(58) Field of Search ..... 347/24, 30, 23, 347/87

(56) References Cited

U.S. PATENT DOCUMENTS 4,959,667 A * 9/1990 Kaplinsky ..... 347/87

FOREIGN PATENT DOCUMENTS

| | | | |
|---|---|---|---|
| JP | 1-281947 | * 11/1989 | ..... B41J/3/04 |
| JP | 5-338203 A | * 12/1993 | ..... 347/30 |
| JP | 7-290721 | * 11/1995 | ..... B41J/2/175 |

* cited by examiner

*Primary Examiner*—David F. Yockey
(74) *Attorney, Agent, or Firm*—Sughrue Mion, PLLC

(57) ABSTRACT

A valve unit is arranged in an ink supply path located between an ink cartridge and a recording head in an ink jet recording apparatus. The valve unit controls the opening and closing of the ink supply paths between the ink cartridge and the nozzle openings during a cleaning operation of the recording head. Air bubbles entered into the recording head when the ink cartridge is replaced are discharged by opening the valve unit after applying negative pressure within a cap covering the nozzle openings. By closing valve units disposed on the other recording head that does not receive a new ink cartridge, unnecessary ink suction discharging ink equally through all nozzle openings can be avoided.

12 Claims, 25 Drawing Sheets

FIG. 10
| NUMBER \ LOCATION | | END | CENTER |
|---|---|---|---|
| ONE NOZZLE | | B | B |
| PLURAL NOZZLES | 2 | A | B |
| | 3 OR LARGER | A | A |
FIG. 11
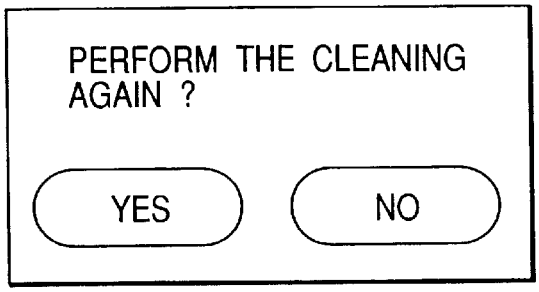
FIG. 12A
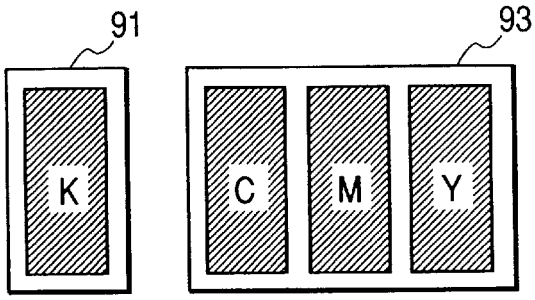
FIG. 12B
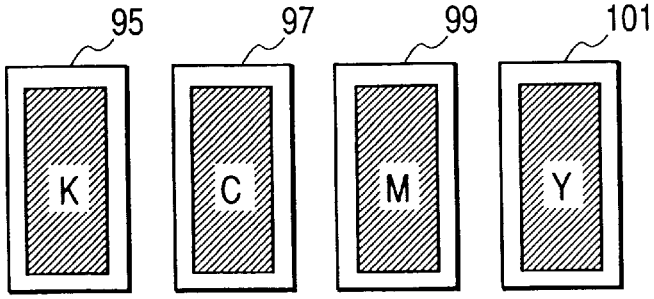

INK JET RECORDING APPARATUS AND RECORDING HEAD CLEANING CONTROL METHOD THEREON

This is a Continuation-In-Part of application Ser. No. 09/239,319, filed on Jan. 29, 1999, which is incorporated herein by reference.

BACKGROUND OF THE INVENTION

1. Field of the Invention

The present invention relates to the structure for cleaning a print head of an ink jet printer and a device for driving the cleaning structure.

The present invention also relates to an ink jet recording apparatus having a recording head which moves in the direction of width of recording paper, and discharges ink droplets onto recording paper in accordance with print data for printing images, and more specifically relates to a control technology for the recording head cleaning operation to recover from inferior printing of the recording head by absorbing ink through nozzle openings of the recording head.

The present invention is based on Japanese Patent Applications Nos. Hei. 10-18657, Hei. 10-154852 and Hei. 10-339052, which are incorporated herein by reference.

2. Description of the Related Art

In the ink jet printer, liquid ink is supplied from an ink tank to a print head, and forcibly discharged in the form of an ink droplet onto a printing medium, through ink jet nozzles of the print head. Sometimes, some of the ink passages ranging from the ink tank to the ink jet nozzles are clogged with air bubbles to possibly obstruct the ink discharging through the passage. To cope with this, the ink jet printer usually has a "clogging-check-pattern printing function", and a "cleaning function". When the former function is exercised, the printer prints a preset clogging check pattern by use of all the nozzles of the print head. A user checks the printed preset pattern to locate a clogged nozzle or nozzles if such defective nozzle is present. The latter function, or the cleaning function, is exercised when the clogged nozzle is located, to suck ink from the clogged nozzle to remove its clogging.

Most of the ink jet printers are designed so as to be capable of printing in monocolor or multi-color mode. To this end, the printer uses four (K (black), C (cyan), M (magenta), Y (yellow)) or larger number of color inks. Further, the printer includes ink tanks and a set of nozzles (e.g., 64 or 128 nozzles), which are respectively provided for those color inks. In a printer using four color inks and having 64 nozzles for each color, the total number of required nozzles is 256, and great.

The clogging check pattern printed out shows the location of a clogged nozzle, if present. Therefore, the user knows which of those nozzles arrayed is clogged. In the event that at least one nozzle is clogged, the user instructs the printer to exercise the cleaning function for removing the clogging. The cleaning operations usually consists of three steps; 1) "flushing" for driving the nozzle to discharge the ink, 2) "wiping" for wiping out the ink from the nozzle surface, and 3) "suction" for sucking the ink from the nozzles by applying negative pressure to the nozzle. Thus, the cleaning operation is complicated. Of those cleaning operation steps, the "suction" process is performed such that 1) the print head is moved to a home position, 2) the entire print surface of the print head is capped with a rubber cap, and 3) the ink is sucked from all the nozzles of the print head thus capped.

In order to solve these problems the ink jet recording apparatus has capping means for sealing the nozzle openings of the recording head in a non-print mode and a cleaning mechanism for cleaning a nozzle plate as the need arises. This capping means functions as a cover preventing ink at said nozzle openings from drying. Said capping means also has a function to solve clogging of the nozzle openings with absorbing ink through the nozzle openings by sealing the nozzle plate with a capping member and applying negative pressure from a suction pump when clogging occurs at the nozzle openings.

The forcible ink suction and discharge process executed to solve clogging of the recording head is generally called the cleaning operation. The cleaning operation is performed when resuming the printing operation after a long halt or when the user turns on a cleaning switch in order to solve clogging of the recording head. Said operation is followed by the wiping operation with a wiping member comprised of elastic plates such as rubber after discharging ink droplets by applying negative pressure.

In this kind of recording apparatus, said recording heads for black ink and color inks are also disposed on one nozzle plate. A black ink cartridge and a color ink cartridge are provided on each recording head for supplying ink. With regard to this kind of recording apparatus for public use, said each cartridge is mounted directly to the top of each recording head respectively.

FIG. 32 is a cross section showing the state that an ink cartridge is mounted on the top of the recording head and the nozzle plate of the recording head is sealed with capping means ascended form the lower part of the recording head.

Specifically, reference numeral 308 in FIG. 32 denotes the ink cartridge. A film member (not shown) is adhered to an ink supply port 308*a* of the ink cartridge 308 so as to prevent ink solvent form vaporizing while ink is stored.

When a new cartridge is installed, the cartridge 308 can be mounted just by thrusting in a manner in which an ink supply port 308*a* of the ink cartridge 308 is placed downward in the opposite side of a supply needle 331, which is hollow and set up upward beyond the back of the recording head 307. With this operation, said ink supply needle penetrates said film adhered to the ink supply port 308*a*. Thus, rubber seal member 308*b* disposed inside the ink supply port is closely connected with the ink supply needle, thereby ink is supplied to the recording head 307 from the cartridge 308.

The capping member 310 arranged in a non-print section of the apparatus ascends from the lower part so as to seal the nozzle plate of the recording head 307 after the carriage mounting said recording head 307 moves to the non-print section. An ink suction port 324 connected to a suction pump (not shown) and an air opening 325 connected to an air valve (not shown) are disposed on the bottom of said capping member 310. When the suction pump operates with the air valve connected to the air opening 325 closed, the cleaning operation is executed for sucking ink from the nozzle openings of the recording head. When the suction pump operates with the air valve open, discharged ink within the capping means 310 can be discharged into a discharge ink tank (not shown).

In the recording apparatus as described above, when replacing an ink cartridge, said capping means seals the nozzle plate of the recording heads and the suction operation is performed for absorbing ink through the nozzle openings by applying negative pressure from the suction pump (the cleaning operation for replacement). Thereby bubbles entered at the time of connecting the ink cartridge and the ink supply needle, are removed. This suction operation discharges said bubbles entered into the recording head during replacement of the cartridge, so that poor printing, such as the so called missing dots, can be avoided.

As described above, in the event of clogging of the nozzle, to remove the clogging, all the nozzles must be subjected to the suction process even if the clogged nozzle is located. This is due to several reasons.

One of the reasons is as follows. The clogging is formed through a complicated mechanism. Therefore, if only the clogged nozzle is sucked, the clogging is not always removed. If so, a natural conclusion is that the sucking of all the nozzles will reliably remove the clogging of the nozzle. However, the sucking of all the nozzles leads to consumption of much ink. The cost of the ink consumption is for the user to bear.

For example, when a black ink cartridge is replaced, ink suction is executed not only through the nozzle openings for discharging black ink but from the nozzle openings for jetting cyan, magenta, and yellow inks as well. Thus, there was a problem that color inks were unnecessarily consumed Moreover, since each nozzle opening absorbs ink equally, rise of negative pressure is delayed and all bubbles are washed away. Consequently, there was a need to absorb and discharge a volume of ink several times that of the capacity of the head.

Except for said cleaning operation for replacement, when specific ink dots are missing, the ink suction operation absorbing ink equally from all nozzle openings is necessary even after the cleaning operation is executed. Thus, ink consumption of each ink cartridges unnecessarily increases and the user is forced to bear the running costs.

Furthermore, when meniscuses at the nozzle openings are formed during the cleaning operation, ink bubbles discharged into the capping means adhere to the nozzle plate. These bubbles are absorbed through the nozzle openings and destroy the meniscuses formed at the nozzle openings. This result in causing disorder of ink droplet's path and missing dots.

Some places where air bubbles are likely to stay are present in the ink passage ranging from the ink tank to the ink jet nozzle. One of the places is a filter chamber located downstream of and near to the ink tank. In case where a replaceable ink cartridge is used for the ink tanks, the filter chambers are provided with needle tubes. When the ink cartridge is set to the printer, the needle tubes are thrust into the related ink tanks. During the thrusting, air bubbles possibly enter the filter chamber through a cylinder-piston action by the ink tank and the needle tube.

Generally, one ink tank supplies ink to a number of ink jet nozzles, and an ink supply passage is branched at a location downstream of the filter chamber to have a number of ink passages. The branching of the ink supply passage leads to an increase of its cross section area. The result is that an ink flow rate in each branched ink passage is reduced, and the force acting to drive the air bubbles out of the filter chamber is weak or insufficient.

SUMMARY OF THE INVENTION

Accordingly, an object of the invention is to effectively drive air bubbles out of the filter chamber through the branched ink supply passages to thereby prevent air bubbles from entering through nozzle openings.

In view of such problems as described above, the object of the present invention is to provide an ink jet recording apparatus which can perform the ink suction operation only through the required nozzles during the cleaning operation for replacement executed after replacing an ink cartridge, and also can reduce the volume of absorbed ink during the ink cleaning operation.

According to one aspect, there is provided an ink jet printer comprising: at least one ink chamber; a print head having a plurality of ink jet nozzles and being connected to the ink chamber; a print controller for driving the print head in order to print; and a capping device for covering the ink jet nozzles of the print head.

The capping device comprises: a cap component having a plurality of cavities for sorting the ink jet nozzles into a plurality of nozzle groups by ink chamber unit, thereby capping all ink jet nozzles corresponding to at least one ink chamber by nozzle group unit; at least one pipe being connected to the cavities of the cap component for supplying negative pressure to the cavities; and a suction controller for controlling the supply of the negative pressure through the pipe to the cavities, thereby supplying the negative pressure independently by every cavity, whereby the suction controller sucks the ink from the ink jet nozzles independently by the nozzle group unit.

In a preferred embodiment of the ink jet printer, the suction controller supplies the negative pressure to one arbitrary cavity of the cap component so as to suck the ink from the ink jet nozzles independently by the nozzle group unit, and all remaining cavities which correspond to one common ink chamber with the arbitrary cavity are sealed.

In another embodiment, the suction controller supplies the negative pressure to all the cavities corresponding to one common ink chamber simultaneously.

In yet another embodiment, a plurality of the ink chambers are provided in the printer, and the cap component has a dimension and number of cavities for capping all of the ink jet nozzles connected to all ink chambers.

In still another embodiment, the cap component comprises one of an integral unit and a plurality of sub-units divided according to the nozzle groups sorted by the ink chamber unit.

In a further embodiment, a plurality of the ink chambers are provided in the printer, and the cap component does not have a dimension and number of cavities for capping all of the ink jet nozzles connected to all ink chambers, and the ink jet printer further comprising a second cap component capping all of the ink jet nozzles at a stretch.

In a still further embodiment, a plurality of the nozzle groups are arranged in a recording medium transporting direction.

In another embodiment, the cap component includes the number of chambers equal to that of the nozzle groups, and caps all the nozzle groups of the print head simultaneously.

In yet another embodiment, one nozzle group is divided into at least two sub-groups of nozzle (in an extreme case, one sub-group consists of one nozzle), and the cap component includes at least two cavities and simultaneously caps those sub-groups.

In still another embodiment, pipes connected to the cavities include valves for closing and opening the pipes. By selectively opening the valves, ink is selectively sucked from the nozzle groups.

In a further embodiment, the pipes connected to the cavities include negative pressure sources, independently operable.

In an additional embodiment, two or larger number of the nozzle groups of the print head are connected to one ink chamber. The cap component includes two or larger number of the cavities so as to simultaneously cap two or larger number of the nozzle groups connected to one ink chamber. Negative pressure is selectively supplied to those cavities. At this time, the remaining cavities are closed (by closing the valves of the pipes associated therewith or applying low negative pressure thereto), thereby preventing air bubbles from entering the remaining nozzle groups.

In another embodiment of the ink jet printer, at least two nozzle groups of the print head are connected to one chamber, and ink is sucked from the two or larger number of nozzle groups connected to the chamber.

In an additional embodiment, the suction controller includes a selective suction portion for supplying negative pressure to one cavity selected from the cavities, and an all-nozzle suction portion for supplying negative pressure to all of the cavities.

In another embodiment, the suction controller includes a selective suction portion for supplying negative pressure to one cavity selected from the plural number of cavities so as to suck ink from the selected cavity, and an all-nozzle suction portion for supplying negative pressure to all of the cavities so as to suck ink from all of the cavities.

In yet another embodiment, the suction controller controls the supply of negative pressure in accordance with clogged nozzle information indicative of a location of a clogged nozzle.

In still another embodiment, the clogged nozzle information includes information indicative of the ink chamber connected to a clogged nozzle, the number of clogged nozzles, and a location of the clogged nozzle on the print head.

In an additional embodiment of the ink jet printer, the suction controller includes a selection table containing a plural number of control guidance corresponding to a variety of clogged nozzle information, and controls the supply of negative pressure in accordance with a specific control guidance, which correspond to the clogged nozzle information, selected from the selection table.

In a further embodiment, the suction controller selects a selective suction mode or an all-nozzle suction mode in accordance with the clogged nozzle information received, and when the selective suction mode is selected, the suction controller sucks ink from at least one nozzle group selected from the plural number of nozzle groups, and when the all-nozzle suction mode is selected, the suction controller simultaneously sucks ink from all of the nozzle groups.

Further, the print controller may include a check pattern print portion for printing a predetermined clogging check pattern used for locating a clogged nozzle by driving the print head.

The ink jet printer may further comprises pattern reading means for reading a printed clogging check pattern to locate a clogged nozzle and to send resultant clogged nozzle information to the suction controller.

The ink jet printer may further comprise input means, operated by a user, for entering clogged nozzle information to the ink jet printer.

In a further embodiment, the ink jet printer is connected to a host controlling device, and the suction controller receives clogged nozzle information from the host controlling device.

In the ink jet printer, the suction controller receives information designating a specific nozzle group or a specific chamber, and supplies negative pressure to a chamber associated with the specific nozzle group or the specific chamber in accordance with the designating information.

The ink jet printer is connected to a host controlling device, and the suction controller receives the designating information from the host controlling device.

According to another aspect of the invention, there is provided a printing system including an ink jet printer and a host controlling device for controlling the ink jet printer. The ink jet printer is constructed described above, and sucks ink from the nozzles of the print head every nozzle group. The host controlling device sends to the ink jet printer selection information necessary for selecting a nozzle group to be sucked from the nozzle groups.

In a preferred embodiment of the printing system, the host controlling device includes a commanding portion for commanding the ink jet printer to print a predetermined clogging check pattern, a user input means by which a user enters user input information indicative of clogged nozzle information, and a selection information generator for generating the selection information on the basis of the user input information entered by the user interface.

In another embodiment of the printing system, the user interface displays a clogging check pattern image on a user interface screen of the host controlling device, and the user enters the user input information by pointing a location on the displayed clogging check pattern image, which corresponds to the location of the clogged nozzle.

According to a further aspect of the invention, there is provided a data storing medium, accessible by a computer, storing a program for executing a process to detect a defective dot forming element of those dot forming elements in a printer, wherein the process comprising the steps of: instructing the printer to print a predetermined clogging check pattern; displaying a clogging check pattern image on a user interface screen of the computer; and specifying the defective dot forming element in a manner that the user points to a location in the displayed clogging check pattern, which corresponds to the defective dot forming element.

According to an additional aspect of the invention, there is provided a data storing medium, accessible by a computer, storing a program for executing a process to instruct an ink jet printer having a number of ink jet nozzles to clean the nozzles, wherein the ink jet printer selectively performs an ink saving cleaning process or a normal cleaning process, the ink saving cleaning process is executed through a selective suction operation to suck ink from only at least one nozzle selected from the ink jet nozzles at any time, and the normal cleaning process is executed through a all-nozzle suction operation for simultaneously sucking ink from all of the ink jet nozzles, and the cleaning instruction process includes a step of displaying an image requesting a user to select the ink saving cleaning process or the normal cleaning process on a user interface screen of the computer, a step of instructing the ink jet printer to execute the ink saving cleaning process or the normal cleaning process selected, by the user, on the user interface screen of the computer.

According to an additional aspect of the invention, there is provided a control method for an ink jet printer having a print head having a number of ink jet nozzles sorted into a plural number of nozzle groups, and a capping device for selectively sucking ink from the nozzle groups by selectively capping the nozzle groups, comprising the steps of: printing a predetermined clogging check pattern and causing a user to locate a clogged nozzle or nozzles; visually presenting a clogging check pattern to the user; obtaining information indicative of the clogged nozzle in a manner that the user points to a location in the displayed clogging check pattern, which corresponds to the clogged nozzle in the printed clogging check pattern; selecting one nozzle group from the nozzle groups on the basis of the clogged nozzle information obtained; and sucking ink from the selected nozzle group.

As well known, a computer program implementing the present invention may be installed in or loaded into the computer by any of various media, e.g., the disk storage, the semiconductor memory, and the communication line.

In another preferred embodiment of the present invention made in order to accomplish the object above, there is provided an ink jet recording apparatus, mounting a ink jet recording head for discharging ink droplets through nozzle openings with ink supplied from an ink cartridge, and capping means for sealing the nozzle openings of said recording head and absorbing ink droplets through the nozzle openings. Said ink jet recording apparatus contains: a valve unit which is disposed between said ink cartridge and the nozzle openings of the recording head for opening and closing the ink supply path between the ink cartridge and the nozzle openings; valve opening/closing control means for controlling opening and closing of said valve unit, interlocked with the cleaning operation to absorb ink droplets through the nozzle openings, with sealing the nozzle openings of the recording head with said capping means.

The valve unit is used to execute the above-mentioned method of selectively sucking ink from the nozzle groups.

In another preferred embodiment of the present invention, there is provided an ink jet recording apparatus, mounting ink jet recording head for discharging different color ink droplets from each nozzle opening with ink supplied from the ink cartridge, and capping means for sealing each nozzle opening of said recording head and absorbing ink droplets through the nozzle openings. Said ink jet recording apparatus contains: a plurality of valve units which are disposed respectively between said ink cartridge and each nozzle opening of the recording head and severally opens and closes ink supply path between the ink cartridge and the nozzle openings; valve opening/closing control means for controlling opening and closing of said each valve unit, interlocked with the cleaning operation to absorb ink droplets trough the nozzle openings, with sealing the nozzle openings of the recording head with said capping means.

In this case, it is desirable that said valve opening/closing control means has options, full-open mode for opening all valves of each valve unit, full-close mode for closing all valves of each valve unit, and alternative valve open mode for opening just one valve by selecting one valve unit alternatively.

Further, it is desirable that said each valve unit can be selected out of said full-open mode, full-close mode, and alternative valve open mode, interlocked with rotational drive by one actuator.

Moreover, in this preferred embodiment, said valve units are positioned in a black ink supply path, cyan ink supply path, magenta ink supply path, and yellow ink supply path respectively.

In another preferred embodiment of the present invention, said valve units are mounted on the carriage together with said ink cartridges and the recording head, and reciprocate along a guide member.

Further, it is desirable that head filters are arranged in the ink supply paths between said valve units and the nozzle openings of the recording head.

Also, in a preferred embodiments of the present invention, said valve units are arranged with at least a pair of ink connecting hole penetrating in the orthogonal direction of the axis of the shaft, disposed across said ink supply paths.

Besides, in a preferred embodiment of the present invention, said capping means is comprised of single capping member which can seal all nozzle openings for ejecting different color ink droplets respectively.

In preferred embodiment of the recording head cleaning control method in a ink jet recording apparatus according to the prevent invention mounting: an ink jet recording head for discharging ink droplets through nozzle openings after being supplied ink from an ink cartridge; capping means for sealing the nozzle openings of said recording head to absorb ink droplets through the nozzle openings; a valve unit arranged between said ink cartridge and the nozzle opening of the recording head for opening and closing the ink supply path between the ink cartridge and the nozzle opening. Said recording head cleaning control method comprising the steps of: in a state said valve unit closed, sealing the nozzle openings of the recording head with said capping means and applying negative pressure within the capping means; in said step with applying negative pressure within the capping means, opening said valve unit to absorb ink through the nozzle openings of the recording head.

In this case, following said ink suction step, it is desirable to further arrange a step for closing the valve unit to prevent air bubbles generated by discharged ink within the capping means by said ink suction step, from being pulled into the nozzle opening of the recording head.

In another preferred embodiment of the recording head cleaning control method in a ink jet recording apparatus according to the prevent invention mounting: an ink jet recording head for discharging different color ink droplets through each nozzle opening after being supplied ink from an ink cartridge; capping means for sealing each nozzle opening of said recording head and absorbing ink droplets through the nozzle openings; a plurality of valve units arranged between said ink cartridge and each nozzle opening of the recording head for opening and closing the ink supply path between the ink cartridge and each nozzle opening respectively. Said recording head cleaning control method comprising the steps of: in a state said each valve unit closed, sealing the nozzle openings of the recording head with said capping means and applying negative pressure within the capping means; in said step with applying negative pressure within the capping means, opening all valve units or a part of said each valve unit and absorbing ink through the nozzle openings of the recording head.

In this case, following said ink absorbing step, it is desirable to further arrange a step for closing all valve units to prevent air babbles generated by discharged ink within the capping means by said ink absorbing step, from pulling into the nozzle openings of the recording head.

According to the ink jet recording apparatus and the record head cleaning control method therein as described above, the valve units arranged on the ink supply paths between the ink cartridges and the nozzle openings, are controlled opening and closing by capping means, interlocked with the cleaning operation for absorbing ink droplets through the nozzle openings.

Therefore, for example, during the cleaning operation for replacing a cartridge, it is possible to discharge entered air bubbles immediately after absorbing ink at the time of loading the cartridge, by controlling said valve units to open valves in a state that a suction pump operates and sufficient negative pressure is applied. In this case, applying sufficient negative pressure within the capping unit in advance enables air bubbles to move quickly and force them to discharge through the nozzle openings. Consequently, the volume of discharging ink can be reduced.

Arranging a valve unit in accordance with each nozzle opening for jetting different color inks enables only required nozzle opening to execute the cleaning operation, for example, by controlling the valve unit corresponding to the nozzle opening where missing dots occur.

Further, exploring a sequence for controlling opening valves of each valve unit after performing the ink suction operation can remove a problem that ink bubbles discharged into the capping means adhere to the nozzle plate of the head, thus air bubbles absorbed through the nozzle openings destroy meniscuses.

Features and advantages of the invention will be evident from the following detailed description of the preferred embodiments described in conjunction with the attached drawings.

BRIEF DESCRIPTION OF THE DRAWINGS

In the accompanying drawings:

FIG. 8A shows a check pattern showing no clogged nozzle, and FIG. 8B shows a check pattern having clogged nozzles;

FIG. 10 is a table showing a logic to determine a type of cleaning process;

FIG. 11 is a diagram showing a display screen for user interface, different from the display screen of FIG. 10;

FIGS. 12A and 12B are diagrams showing variations of the head structure;

DETAILED DESCRIPTION OF THE PREFERRED EMBODIMENTS

Figure 1:
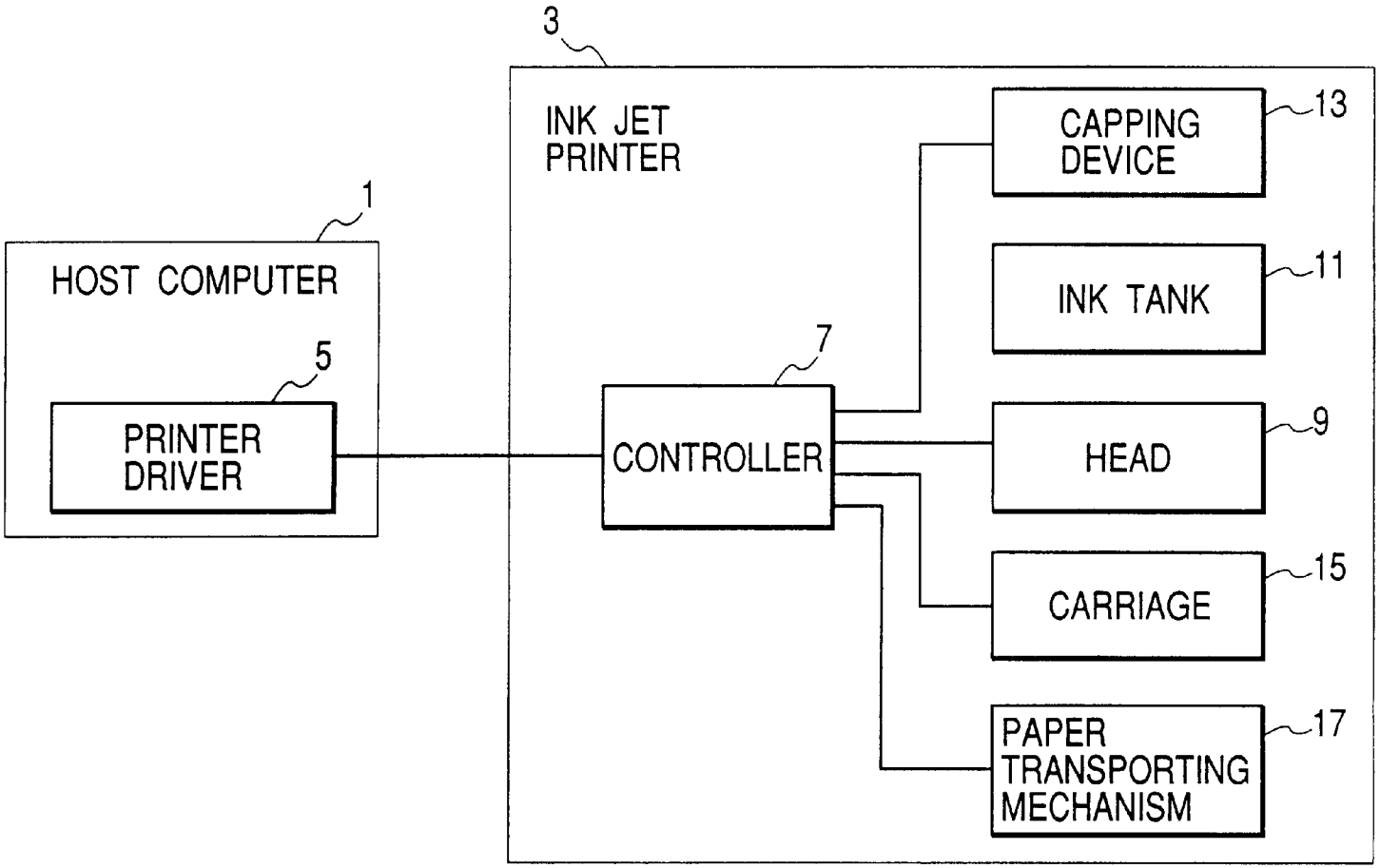
FIG. 1 is a block diagram showing an overall print system which is an embodiment of the present invention.

FIG. 1 is a block diagram showing an overall print system which is an embodiment of the present invention.

As shown, an ink jet printer 3 is connected to a host computer 1, through a local printer cable or a communication network. The host computer 1 contains a printer driver 5 as a software for sending to the printer 3 commands that instruct the printer 3 to execute a print process and a cleaning process. The printer 3 includes a controller 7, a print head 9, an ink tank 11, a capping device 13, a carriage mechanism 15, a paper transporting mechanism 17. The controller 7 receives commands from the printer driver 5, interprets the commands, and controls the above-mentioned portions, devices and mechanism of the printer. The print head 9 includes a number of ink jet nozzles. The capping device 13 includes a rubber cap applied to the print head 9, a pump for sucking ink from the print head 9, and the like. The carriage 15 provides a path along which the print head 9 runs. The paper transporting mechanism 17 transports a printing medium or paper.

For the cleaning of the ink jet nozzles to which the invention is directed, the printer driver 5 has 1) a function to send to the printer 3 a command to print a "clogging check pattern" to check whether or not a clogged nozzle or nozzles are contained in the print head 9, 2) another function to select a nozzle group of the print head 9 to be subjected to a cleaning process on the basis of the result of printing the clogging check pattern, and 3) yet another function to send to the printer 3 a command to clean the selected nozzle group, and 4) other functions. The capping device 13 of the printer 3 is operable in either of the following two modes for performing the "suction" step of the cleaning process; in a first mode, the capping device sucks the nozzles for each group of nozzles arrayed on the print head 9, and in a second mode, it sucks all the nozzles at a stretch. The controller 7 of the printer 3 has at least two functions. A first function is exercised when the controller 7 receives a print command to print a clogging check pattern from the printer driver 5; in responds to the print command, the controller 7 drives the print head 9, the carriage mechanism 15 and the paper transporting mechanism 17 to print out the clogging check pattern on a printing paper. A second function is exercised when the controller 7 receives a cleaning command from the printer driver 5; in response to the print command, the controller 7 drives the print head 9, the carriage mechanism 15 and the capping device 13 to perform the cleaning process.

Figure 2:
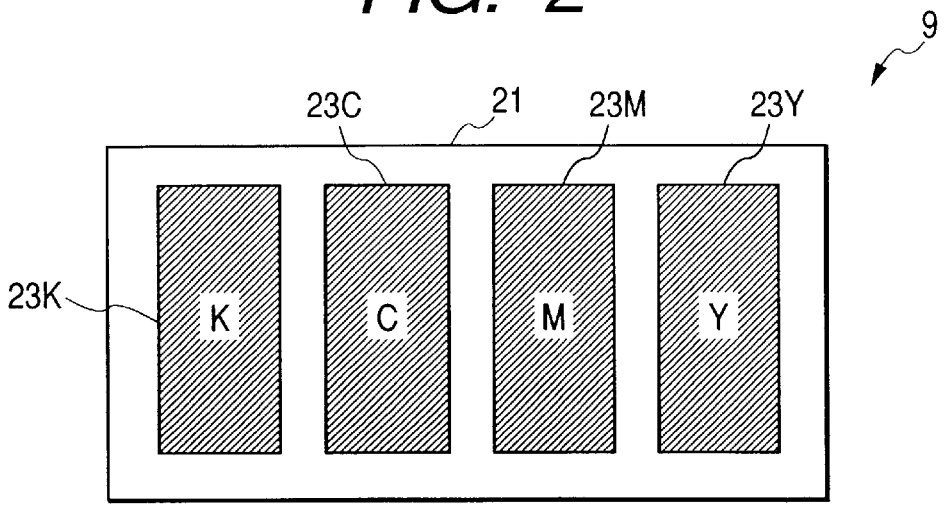
FIG. 2 is a front view schematically showing a print surface (facing a printing medium) of a print head.
Figure 3:
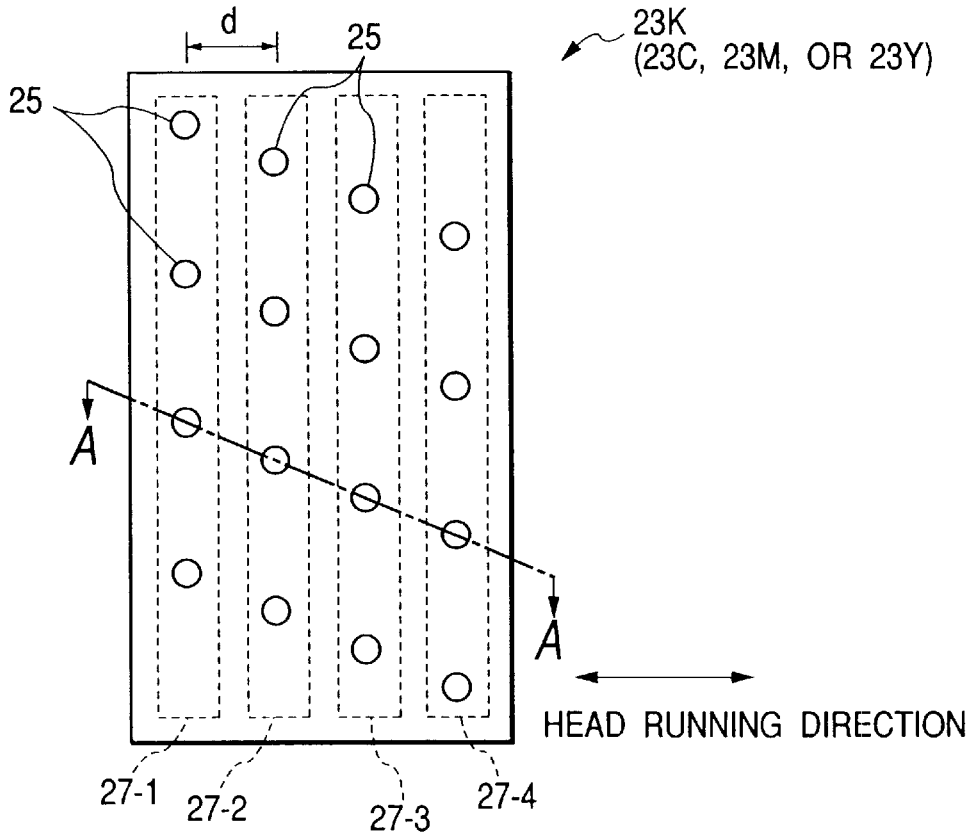
FIG. 3 is a front view showing a nozzle array for one color.

FIG. 2 is a front view schematically showing a print surface (facing a printing medium) of the print head 9. As shown, the print surface of the print head 9 includes a sheet of head plate 21 in the embodiment under discussion. Four large nozzle orifice groups 23K, 23C, 23M and 23Y for discharging four color inks of K, C, M and Y are formed in the head plate 21 while being arranged as shown. To be more specific, as shown in FIG. 3, a large nozzle orifice group 23 for each color has sixteen nozzle orifices 25. Those sixteen nozzle orifices are arranged into four linear nozzle arrays 27-1 to 27-4. One linear nozzle array 27 corresponds to one nozzle group unit in this embodiment. The head configuration and the nozzle orifice arrangement, which are actually employed by the printers, come in many varieties. In recent printers, six or seven color inks are used, and the number of nozzles per color is great, for example, 32, 64 or 128. In the embodiment description to follow, the head configuration and the nozzle (or orifice) arrangement, which are shown in FIGS. 2 and 3, are employed for simplicity of explanation.

Figure 4:
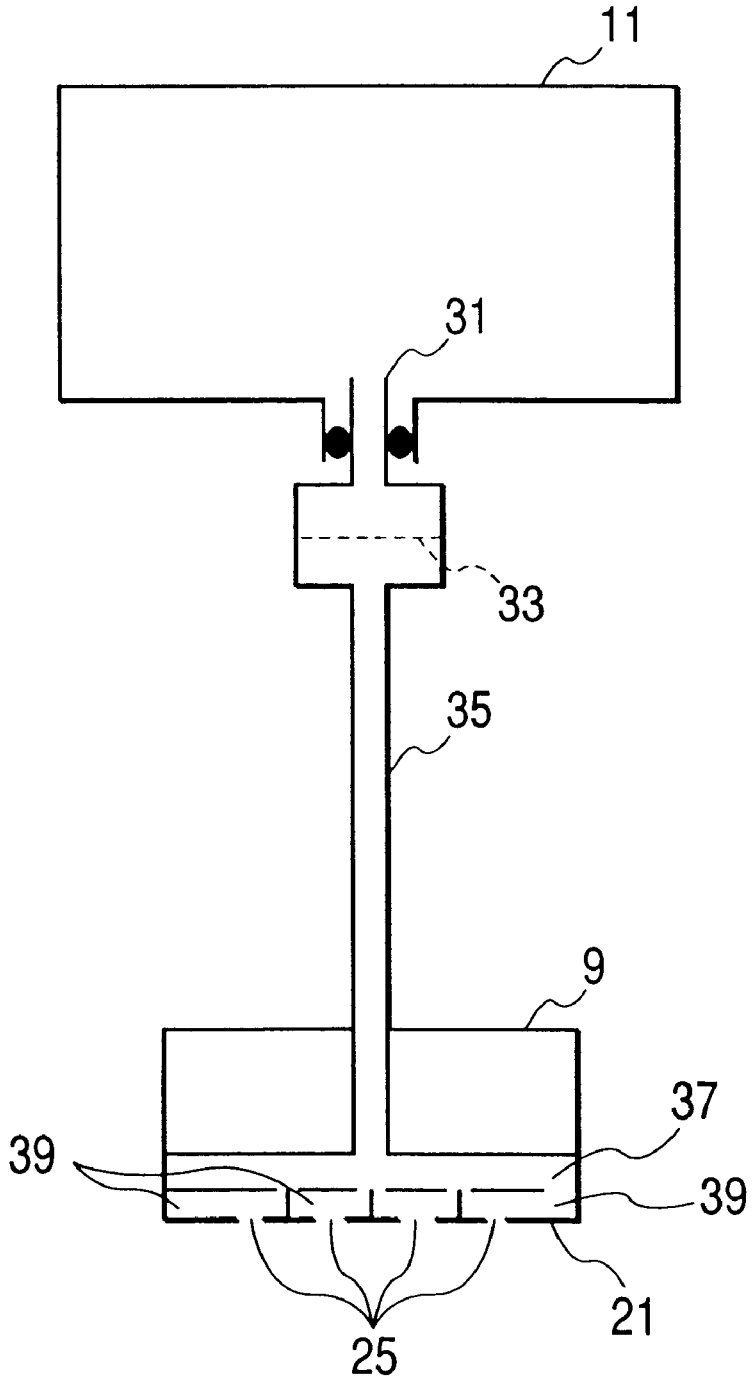
FIG. 4 is a cross sectional view schematically showing an ink passage ranging from an ink tank to the print head.

FIG. 4 is a cross sectional view schematically showing an ink passage for one color ink, which ranges from the ink tank 11 to the print head 9.

As shown, a needle tube 31 is thrust into the ink tank 11, and ink is fed from the needle tube 31 to the print head 9, through a feed pipe 35. A filter 33 is provided at the base part of the needle tube 31. The filter filters off air bubbles and dust particles that come in when the needle tube 31 is thrust into the ink tank 11. Within the print head 9, the ink is temporarily stored in a reservoir 37; the ink is fed from the reservoir 37 to cavities 39 respectively associated with the nozzles 25; and the ink is jetted out of the nozzles 25 by expansion/contraction motions of the cavities 39 caused by piezoelectric elements associated therewith.

A major cause for the nozzle clogging is that air bubbles stay in the ink passage, and block or impede the flow of ink through the ink passage. It is estimated that the places where the air bubbles are easy to stay in the ink passage are the filter 33, the feed pipe 35 and the cavities 39. When air bubbles stay in the filter 33 and/or the feed pipe 35, no ink is possibly discharged from a plural number of nozzles, particularly nozzles of relatively large flow resistance (typically, the nozzles located far from the connection part of the reservoir 37 and the feed pipe 35; for example, the nozzles located to the ends of the nozzle orifice arrays). The sucking of ink from all the nozzles (cleaning of those nozzles) will be effective for this type of the nozzle clogging. When the bubble stays in a specific cavity or cavities 39, only the nozzle or nozzles 25 associated with the cavity or cavities 39 are clogged. In this case, the nozzle clogging can be removed by sucking ink from only the clogged nozzle or nozzles.

Figure 5:
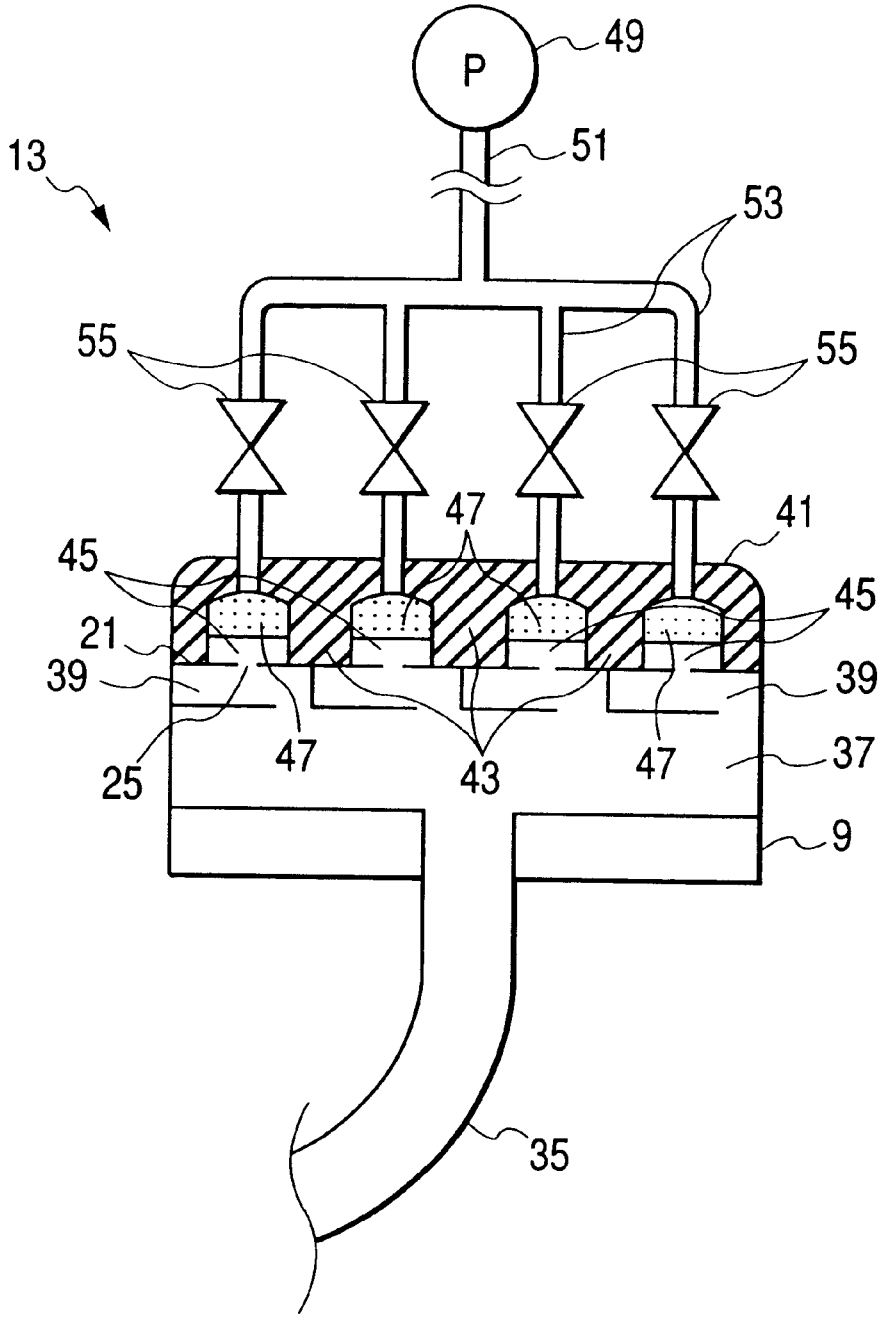
FIG. 5 is a cross sectional view, taken along line A—A in FIG. 3, showing a structure of a capping device.

FIG. 5 is a cross sectional view, taken along line A—A in FIG. 3, showing a structure, in particular for "suction", of a capping device 13.

The capping device 13 includes a rubber cap 41 as shown. The rubber cap 41 is applied to the print surface when the print head 9 is at a home position. Normally, a small negative pressure is applied from a suction pump 49 to the rubber cap 41 being applied to the print head 9, for the purpose of preventing the nozzles 25 from being dried. Under the small negative pressure, the peripheral edge of the rubber cap 41 is brought into close contact with the print surface of the print head to air-tightly seal the print surface. To perform a cleaning process, a large negative pressure is applied from the suction pump 49 to the rubber cap 41 being applied to the print head 9, to thereby suck ink from the nozzle or nozzles 25.

The rubber cap 41 includes three partitions 43 of rubber. With those partitions, four small spaces or cavities 45 are formed in the rubber cap 41. Those small cavities 45 are narrow and long when viewed from the front, and sized so as to cover the four nozzle arrays 27-1 to 27-4 (FIG. 3). When the rubber cap 41 is applied to the print head 9 and receives a small negative pressure, the partitions 43 are also brought into close contact with the print surface of the print head, so that the small cavities 45 are isolated from one another. The small cavities 45 are connected respectively through suction pipes 53 to the suction pump 49. Valves 55, which are independently operable for its opening and closing, are coupled to the suction pipes 53, respectively. In a cleaning mode of the printer, those four valves 55 are selectively operated for its opening and closing to suck the ink from the corresponding nozzle arrays 27-1 to 27-4. To suck the ink from all the nozzles 25, the valves 55 are all opened. Sponge 47 is put into each of the small cavities 45 to absorb the ink running out of the nozzles 25.

The rubber cap 41 shown in FIG. 5 is provided for the large nozzle group of one ink color in the print head 9. In an actual printer, four rubber caps 41 are provided for the nozzle groups of four ink colors in similar fashion. In this case, those four rubber caps may be separated from one another or take an integral form. Provision of one suction pump 49 suffices for all the rubber caps.

Figure 6:
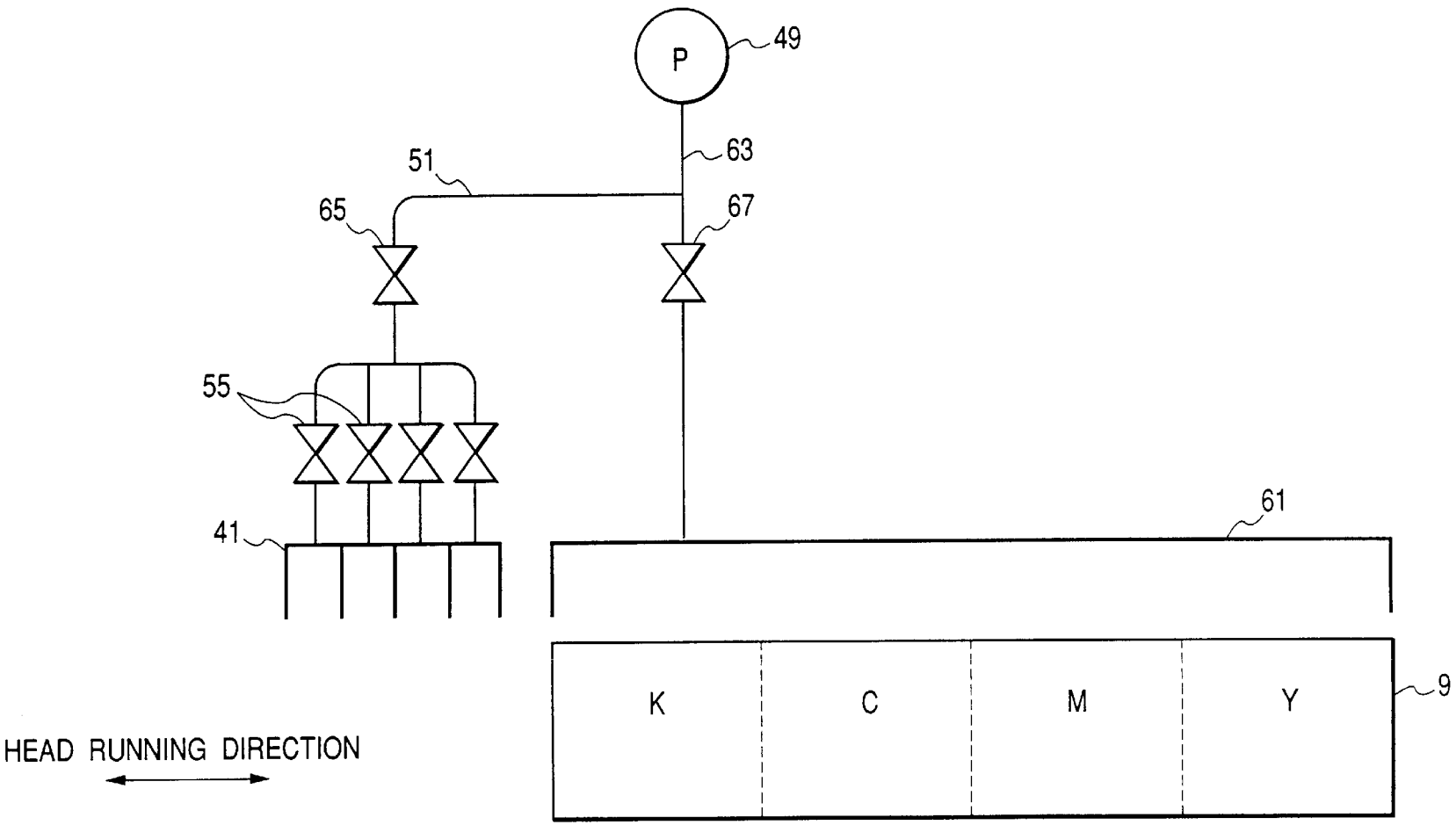
FIG. 6 is a diagram showing a modification of the capping device.

FIG. 6 is a diagram showing a modification of the capping device 13. The capping device has the combination of 1) a conventional rubber cap 61 capable of sucking the inks from all the nozzles at a stretch and 2) a rubber cap 41 capable of sucking the ink from the nozzles every nozzle array unit (nozzle group unit) of one ink color as shown in FIG. 5. The two rubber caps 41 and 61 are arranged in the running direction of the print head 9. Therefore, the rubber cap 41 or 61 can be selected and applied to the print head 9 by moving the print head. The rubber caps 41 and 61 are connected respectively through suction pipes 51 and 63 to a suction pump 49. Those suction pipes are respectively coupled to valves 65 and 67, independently operable. The capping device of this modification may be used in such a manner that the rubber cap 61 is used for the purposes of preventing the nozzles from being dried and of sucking all the nozzles, and the rubber cap 41 is used for the purpose of sucking the nozzles per unit of nozzle array, that is, unit of nozzle group. The rubber cap 41 is designed so as to cover only the nozzle groups (nozzle arrays) of one ink color. Because of this, where the nozzle-array basis (nozzle-group basis) suction is used, it is impossible to simultaneously suck the nozzles of a plural number of ink colors. However, this incapability feature does not create no problem in practical use because it is a rare case that the nozzles of a plural number of ink colors are simultaneously clogged, and in most cases, one or two nozzles of one ink color are clogged.

Figure 7:
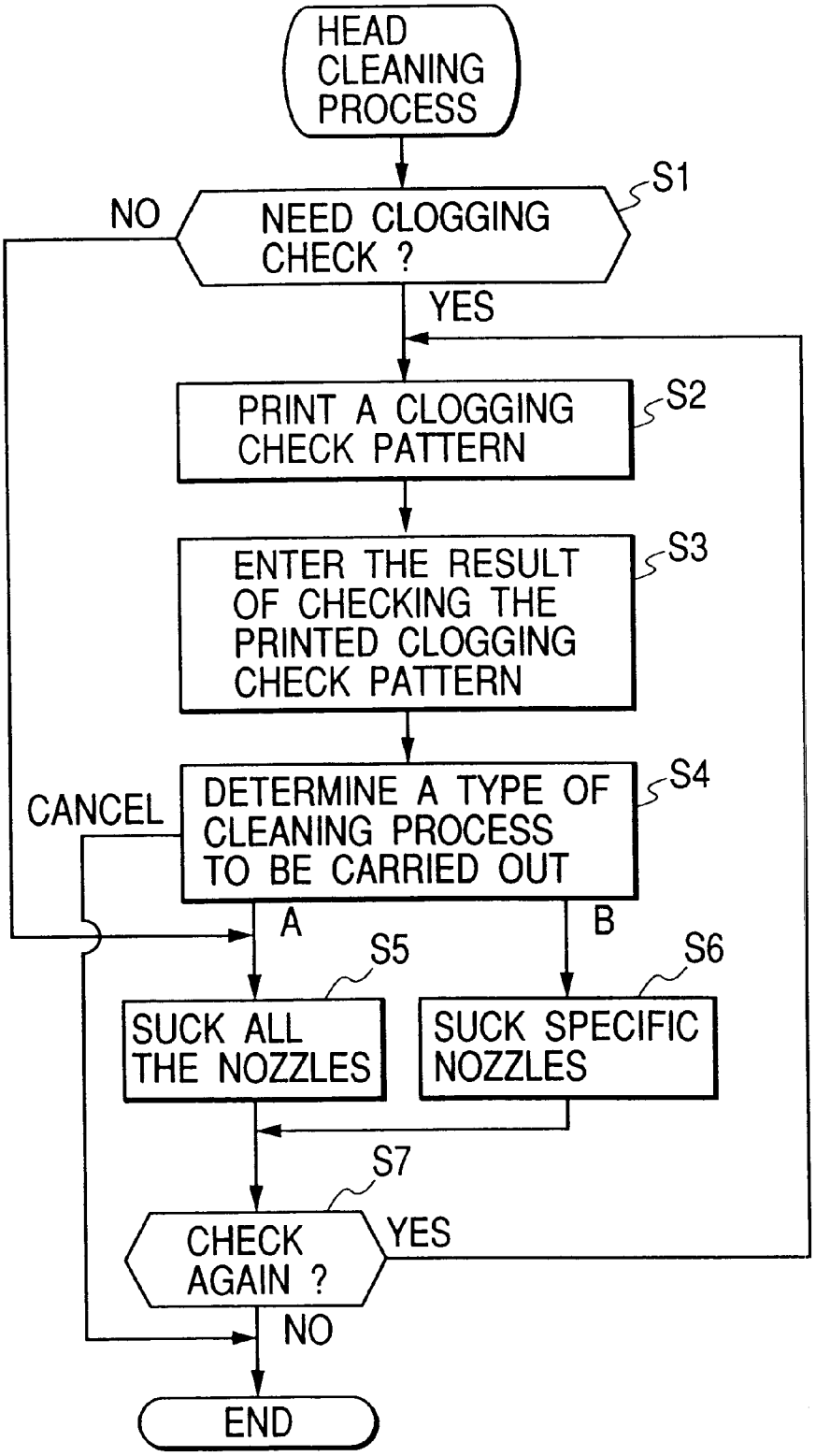
FIG. 7 is a flow chart showing a cleaning process performed by a printer driver.

FIG. 7 is a flow chart showing a cleaning process carried out by a printer driver 5. In the description given below, only the "suction" step of the cleaning process will be discussed, and the other steps of "flashing" and "wiping" of the cleaning process will not be referred to, for simplicity.

A step S1 is first executed: the printer driver 5 questions the user as to whether or not a clogging check is performed. If the user answers in the negative (does not need the clogging check), the printer driver 5 jumps to a step S5. In this step, the printer driver sends to the printer 3 a command that directs the printer to execute a conventional cleaning process for sucking all the nozzles. Upon receipt of the command, the printer 3, more exactly the controller 7 of the printer 3, moves the print head 9 to the home position; caps the print head 9 with the rubber cap 41 (FIG. 5); opens all the four valves 55; and drives the suction pump 49 to suck the inks from all the nozzles 25.

Figure 8A:
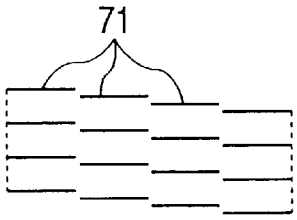
FIGS. 8A and 8B are diagrams showing an example of a clogging check pattern for one color.
Figure 8B:
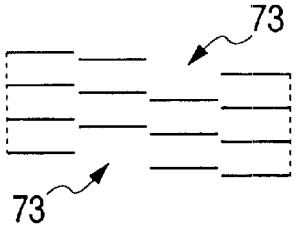

If the user answers in the affirmative (needs the clogging check), the printer driver 5 sends to the printer 3 a command that directs the printer to print out a "clogging check pattern". In response to the command, the printer 3 prints out a clogging check pattern (step S2). The pattern printing is carried out such that the inks are jetted out from all the nozzles 25 of the print head 9 while moving the print head 9 a distance of the pitch d (several mm) between the nozzle arrays 27 (FIG. 3). The clogging check pattern consists of four sub-patterns of four colors K, C, M and Y arranged side by side (FIG. 8B). Each sub-pattern, as shown in FIG. 8A, consists of four groups of vertically arrayed horizontal short bars, those groups being arranged side by side in a state that the groups are stepwise lowered to the right (viewed in the drawing). In the sub-pattern of one ink color shown in FIG. 8A, 16 number of horizontal short bars are printed with 16 number of nozzles 25 of one ink color shown in FIG. 3. An example of the sub-pattern printed by the nozzle group including clogged nozzles is depicted in FIG. 8B. As shown, the locations 73 corresponding to the clogged nozzles are blank, viz., the short bars are not printed there.

Figure 9:
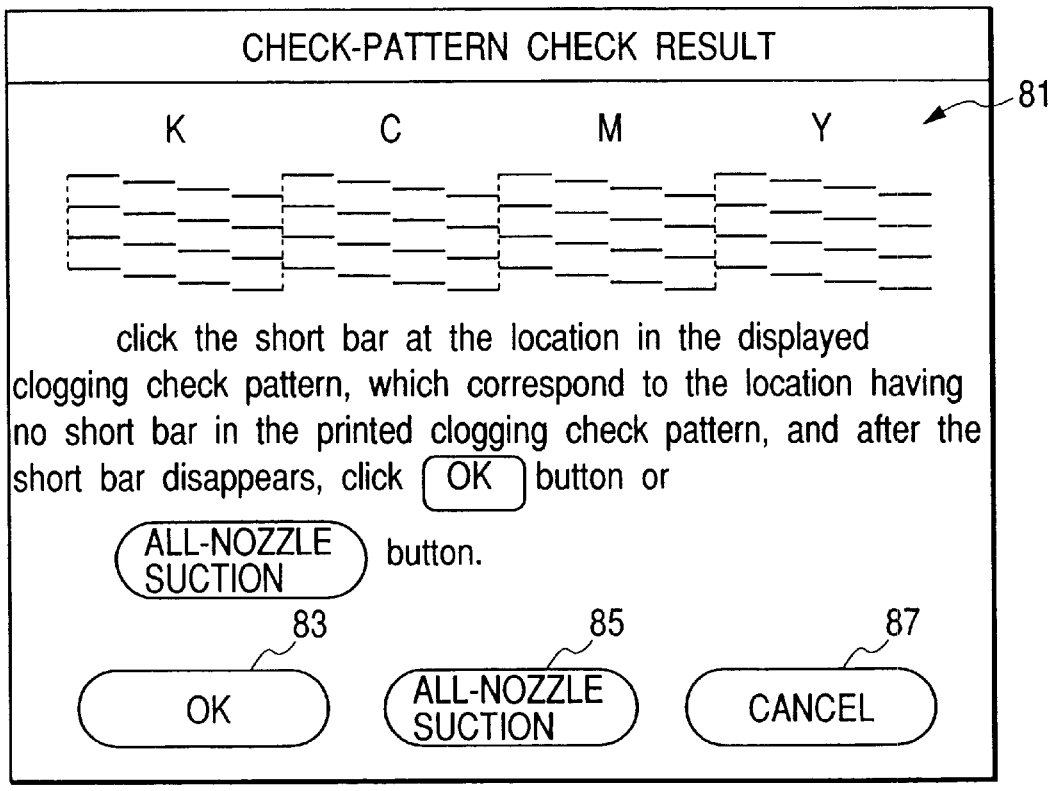
FIG. 9 is a diagram showing a clogging-check-result input screen.

After commanding the printer 3 to print such a clogging check pattern, the printer driver 5 visually presents a display screen used for inputting the result of checking a printed clogging check pattern, as shown in FIG. 9, and requests the user to enter the result of checking the printed clogging check pattern (step S3). As shown, the display screen of FIG. 9 includes a picture 81 of a clogging check pattern. When the user mouse-clicks the short bar in the picture 81 of a clogging check pattern, the clicked short bar disappears or changes its color. The number assigned to the clicked short bar is stored, as the clogged nozzle number, into the printer driver 5.

Accordingly, the user examines the printed clogging check pattern and clicks with the mouse the short bar at the location in the displayed clogging check pattern in the picture 81, to show the printer driver 5 the location of the clogged nozzle. The user mouse-clicks all the short bars at the locations in the displayed clogging check pattern, which correspond to the blank locations in the printed clogging check pattern, and mouse-clicks an "OK" button 83.

If the entering operations are troublesome, an "All-Nozzle Suction" button 85 may be clicked with the mouse. In the event that no clogged nozzle is found, a "cancel" button 87 may be clicked with the mouse.

When the "OK" button 83, "All-Nozzle Suction" button 85 or "cancel" button 87 is clicked, the printer driver 5 determines if the cleaning process is executed on the basis of the input result. If the cleaning process is executed, the printer driver 5 determines a type of cleaning (step S4). The cleaning consists of a conventional cleaning which sucks all the nozzles and a selective cleaning which sucks the nozzles of a specific nozzle array. When the "cancel" button 87 is clicked on the input screen of FIG. 9, the printer driver 5 recognizes that the cleaning process is not executed, and ends this process. When the "All-Nozzle Suction" button 85 is clicked, the printer driver 5 recognizes that the conventional cleaning is performed, and advances to the step S5.

When the "OK" button 83 is clicked, the printer driver 5 determines if the cleaning to be executed is of the conventional type or of the selective type, on the basis of the clogged nozzle number already stored. The logic used for the determining the type of cleaning is as shown in FIG. 10. In a case that only one clogged nozzle is contained in the nozzle group of one color (i.e., the nozzle group connected to one common ink chamber), or in another case that two clogged nozzles are contained and one of them is located relatively close to the center of the nozzle group (relatively close to the connection part of the feed pipe 35 and the reservoir 37 (FIG. 4) and hence its flow resistance is relatively small), the printer driver 5 determines that the cleaning to be executed is of the selective type in which a specific nozzle array to which the clogged nozzle belongs is sucked, and advances to a step S6. The reason for this is that in this case, the nozzle clogging is highly probably caused by the fact that air bubbles stay in the cavity 39 of the clogged nozzle. In a further case that three or larger number of clogged nozzles are contained in the nozzle group of one color or in an additional case that two clogged nozzles are contained in the nozzle group of one color and are both located relatively close to the end of the nozzle group (viz., their flow resistance is relatively large), the nozzle clogging is highly probably caused by the fact that air bubbles stay in the filter 33 and the feed pipe 35 (FIG. 4). For this reason, the printer driver 5 determines that the cleaning to be executed is of the conventional type or the all-nozzle suction type, and advances to the step S5.

In the step S5, as already described, the printer driver 5 sends a command for the conventional cleaning to the printer 3, and the printer executes the conventional cleaning process. In the step S6, the printer driver 5 sends to the printer 3 a command for the selective cleaning in which the nozzle array 27 containing the clogged nozzles is designated as an object to be sucked. In response to the command, the printer 3 moves the print head 9 to the home position; covers the print head 9 with the rubber cap 41; opens the valve 55 for the nozzle array 27 (one or two or larger number of nozzle arrays) as the object to be sucked, while closing the valves 55 for the remaining nozzle arrays 27; and sucks ink from only the nozzle array 27 as the object to be sucked. The above-mentioned measure taken for preventing air bubbles coming from the other nozzles (remaining nozzles) than the sucked nozzle from entering the sucked nozzle when the nozzles of the nozzle array to be sucked are sucked, is to merely close the valves for the remaining nozzles. An alternative measure is that the valve for the sucked nozzle is opened, and the valves for the remaining nozzles are opened with a preset time.

As described above, following the execution of the conventional or selective cleaning process, the printer driver 5 questions the user as to whether or not the clogging check is made again (step S7). If the answer to the question is YES (re-check of the clogging is made), the printer driver 5 returns to the step S2, and commands the printer 3 to print a clogging check pattern. In this case, the step S3 is executed to present the input screen of FIG. 9. An alternative is that after the clogging check pattern is printed for the recheck, the printer driver 5 presents a display screen as shown in FIG. 11, and questions the user simply as to whether or not the cleaning is made again. In this alternative, if the user clicks a "YES" button on the question screen of FIG. 11, the printer driver 5 advances to the step S5, and executes the conventional cleaning process again. If he clicks a "NO" button, the printer driver 5 ends this process.

It is evident that the present invention may be implemented into other various constructions and process than the specific ones described above.

In the above-mentioned embodiment, the print surface of the print head 9 has one sheet of head plate 91 as shown in FIG. 2. The invention may be applied to other print surfaces as shown in FIGS. 12A and 12B. In the example of FIG. 12A, the print surface has two head plates 91 and 93, one for black ink and the other for color inks. In the example of FIG. 12B, the print surface has four head plates 95 to 101 for the respective colors.

Figure 13:
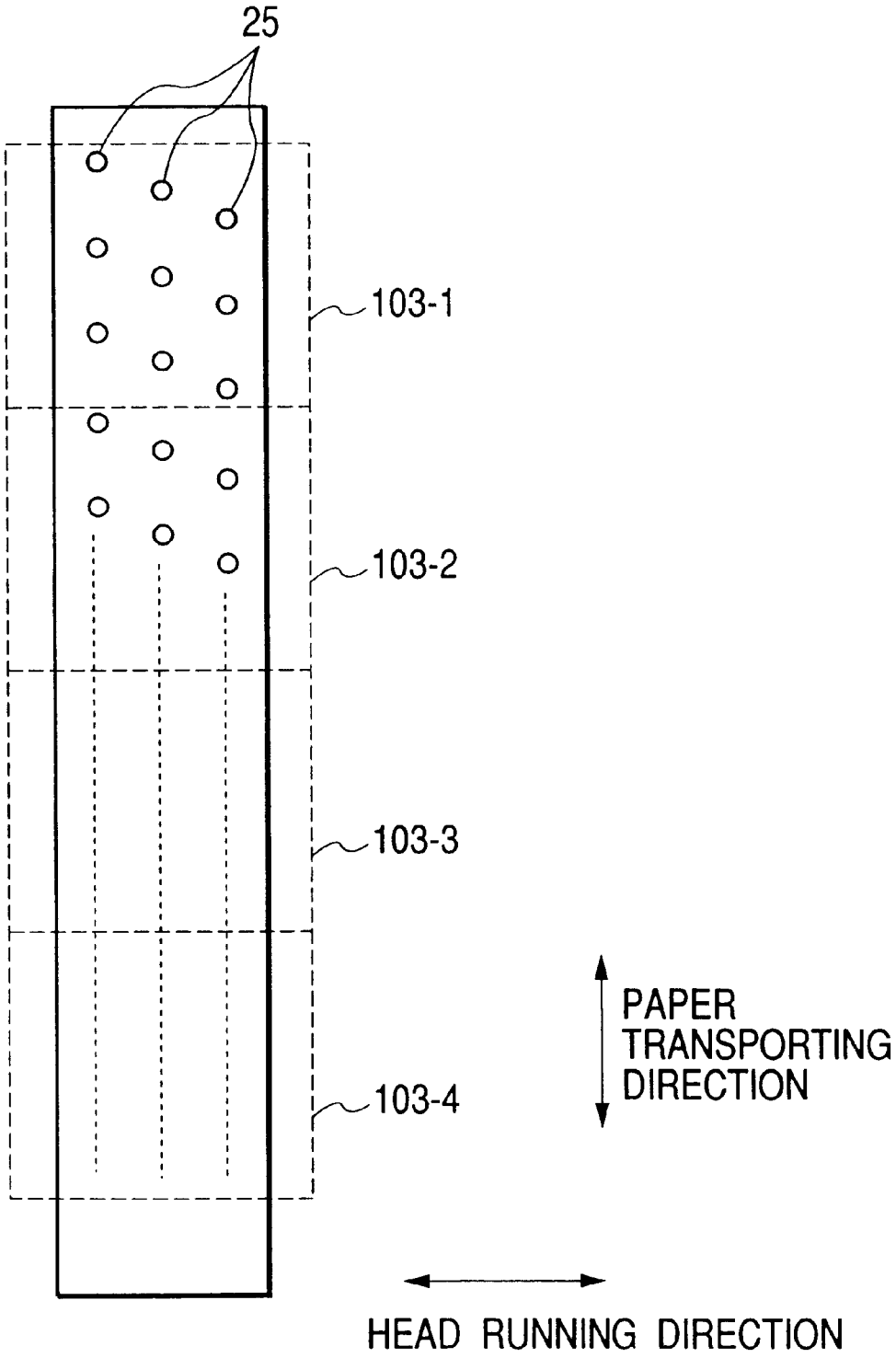
FIG. 13 is a diagram showing another way of grouping the nozzles.

In the above-mentioned embodiment, the discharge orifices formed in the print surface of the print head are grouped into orifice arrays (nozzle groups) 27-1 to 27-4 (FIG. 3). These orifice arrays are arranged side by side in the head running direction. The cleaning of those discharge orifices is performed every orifice array (the selective cleaning is used), that is, every nozzle group. An alternative is shown in FIG. 13. As shown, the discharge orifices formed in the print surface of the print head are grouped into nozzle groups (nozzle orifice arrays) 103-1 to 103-4. These nozzle groups 103 are arranged in the paper transporting direction. The cleaning of those discharge orifices is performed every nozzle group 103 (the selective cleaning is used). Another alternative is that the discharge orifices are grouped into orifice arrays every color, and the selective cleaning process is applied to those discharge orifices.

Figure 21A:
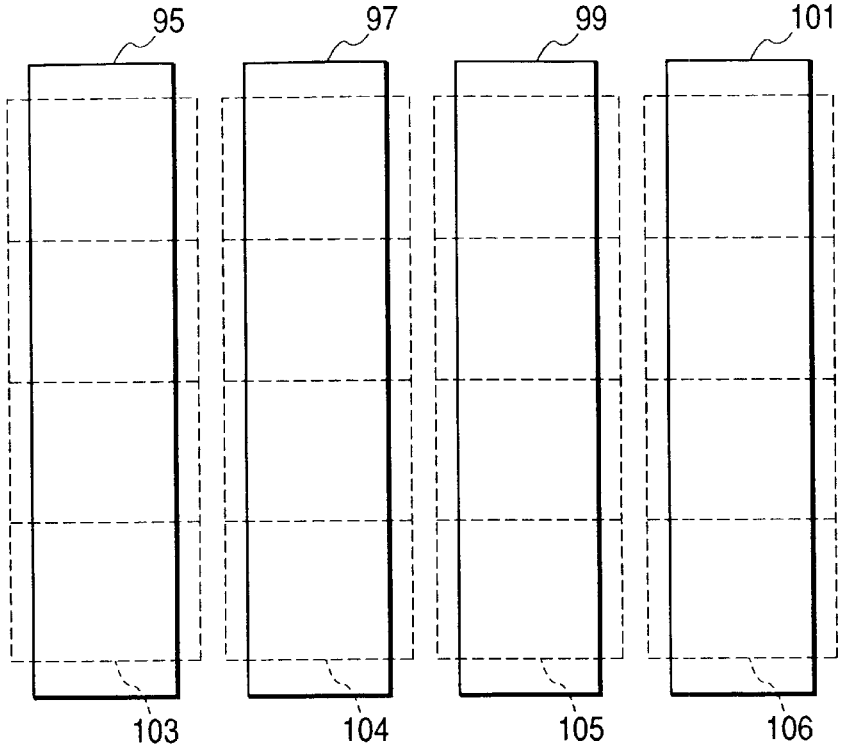
FIGS. 21A and 21B are diagrams showing a plurality of print heads each having way of grouping of the nozzles shown in FIG. 13.
Figure 21B:
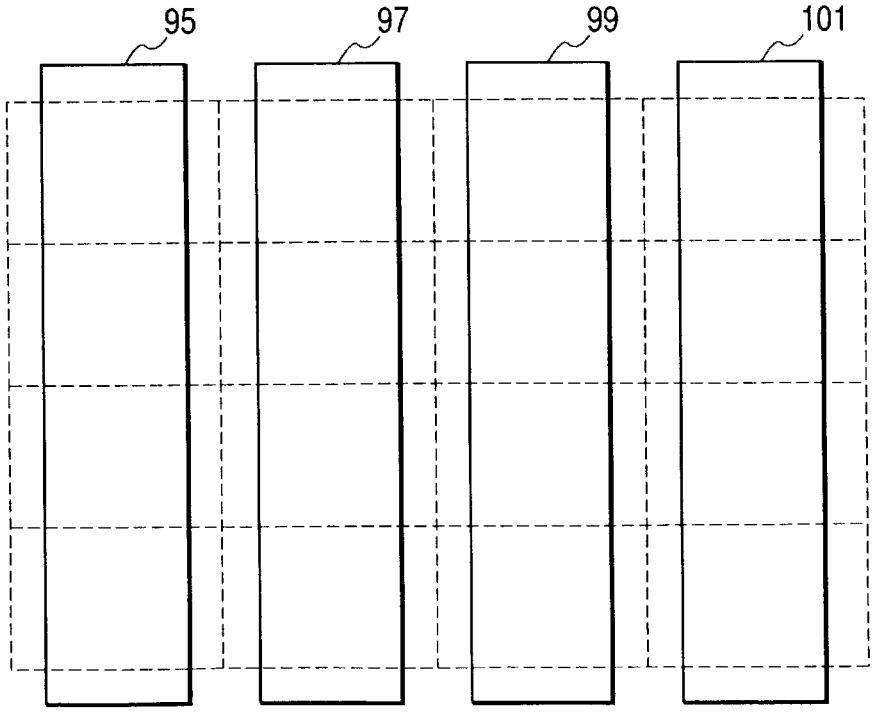

Further, a plurality of capping devices may be prepared in the printer according to the number of head plates 95 to 101 as shown in FIG. 21A. In FIG. 21A, each of capping devices has one cap rubber including four cavities. On the other hand, only one capping device may be prepared in the printer as shown in FIG. 21B. In FIG. 21B, the capping device has one cap rubber including sixteen cavities. Nozzle orifices 25 are omitted in FIGS. 21A and 21B for simplification of explanation.

The logic to determine the selective cleaning (step S4 in FIG. 7) may take any other suitable logic than the already mentioned one. An example of another simple logic is that the partial cleaning is applied to all the nozzle orifices of a nozzle orifice group containing clogged nozzles, irrespective of the location and the number of the clogged nozzles.

Further, the discharge orifices of the nozzles may be respectively covered with cavities formed in the rubber cap. To the cleaning, clogged nozzles are specified, and only the specified ones are subjected to the ink suction. The result is that the ink consumption by the cleaning is minimized.

Figure 14:
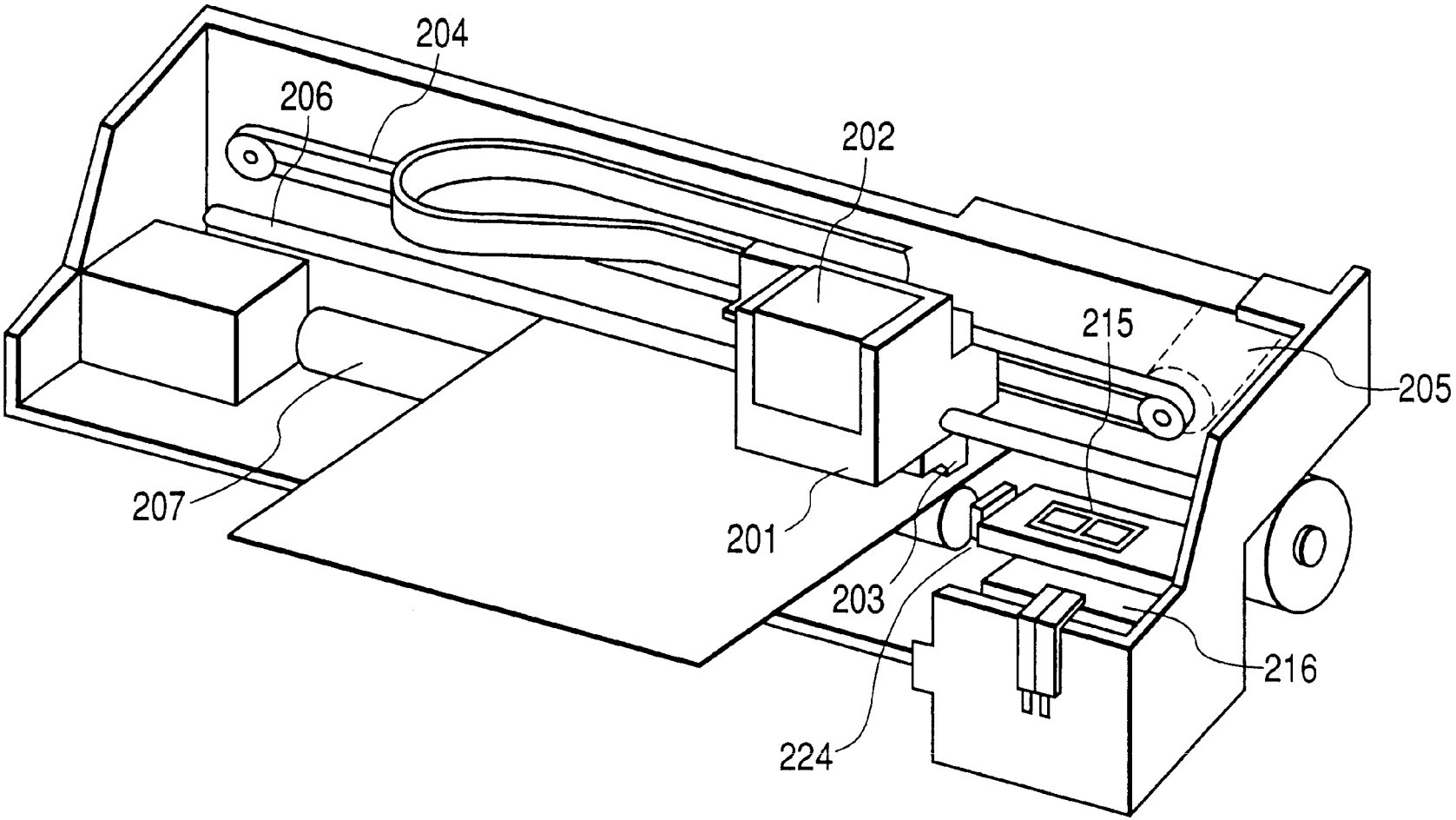
FIG. 14 is a perspective view showing a structure of an ink jet printer which is another embodiment of the present invention.

FIG. 14 is a perspective view showing a structure of an ink jet printer which is another embodiment of the present invention.

An ink tank (of the cartridge type) 202 is detachably attached to the upper side of a carriage 201. An ink jet print head 203 is fixedly attached to the lower side of the carriage 201. The carriage 201 is coupled with a motor 205 by a belt 204, and it is reciprocatively movable in the axial direction of a platen while being guided by a guide rail 206.

Figure 15:
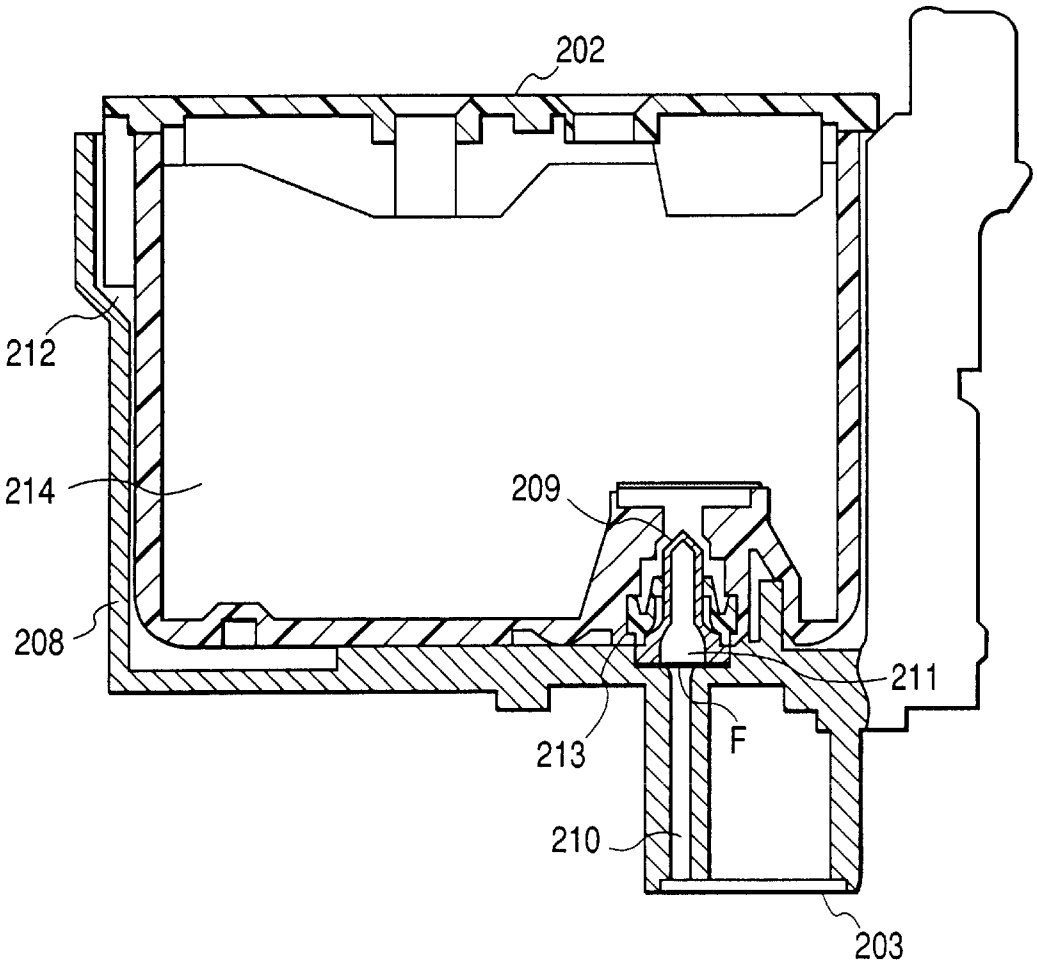
FIG. 15 is a cross sectional view showing a structure for mounting a print head and an ink tank on a carriage in the FIG. 14 printer.

FIG. 15 is a cross sectional view showing a structure for mounting the print head 203 and the ink tank 202 on to carriage 201 in the FIG. 14 printer.

A holder 208 for holding the ink tank 202 is fastened to the carriage 201. A print head 203 is fastened to the lower side of the bottom wall of the holder 208, while a needle tube 209 is secured to the upper side of the bottom wall. An ink supply passage 210 communicates the print head 203 with the needle tube 209. A filter chamber 211 is located between the needle tube 209 and the ink supply passage 210. The ink tank 202 is put in a tank receiving space 212 within the holder 208. When the ink tank 202 is put in the tank receiving space 212, the needle tube 209 thrusts into the ink tank 202, through an ink supply port 213, so that an ink chamber 214 communicates with the ink supply passage 210.

A capping device 215 is provided at the home position situated at the end of the traveling path of the carriage 201. The capping device 215 sealingly covers the print surface of the print head 203. The capping device 215 has at least three functions; a first function to prevent the nozzles from being dried, a second function to absorb ink discharged at the time of flashing, and a third function to expel ink from the ink jet nozzles by applying negative pressure to the nozzles from a suction pump 216.

Figure 16:
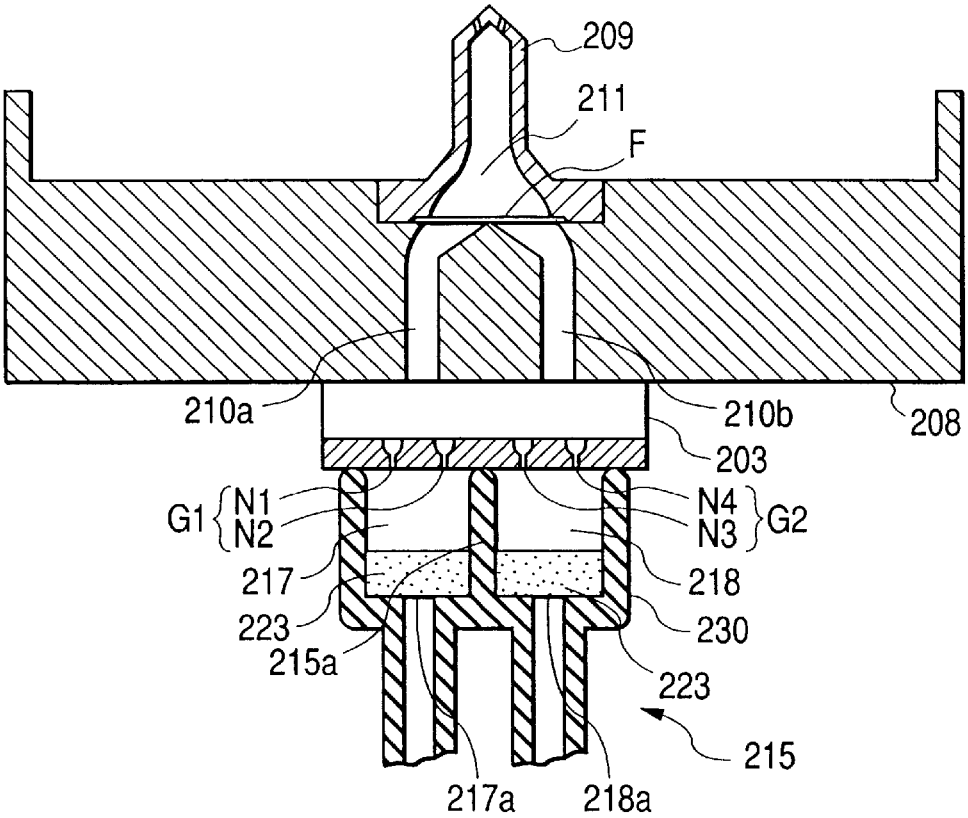
FIG. 16 is a cross sectional view showing an example of a capping device.
Figure 17:
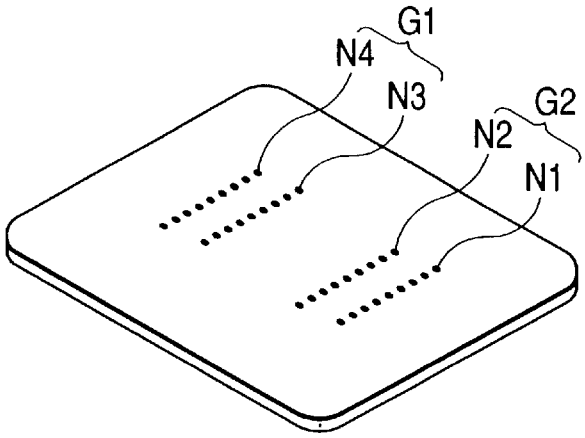
FIG. 17 is a perspective view showing a print surface of a print head to which the FIG. 16 capping device may be applied.

FIG. 16 shows an example of the capping device 215. FIG. 17 shows a print surface of a print head 203 to which the capping device 215 may be applied.

As shown, orifices are arranged into four linear orifice arrays N1 to N4 on the print surface of the print head 203. Those linear orifice arrays N1 to N4 are further arranged into two nozzle orifice groups G1 and G2. To supply ink from one needle tube 209 to the two nozzle groups G1 and G2, the ink supply passage 210 situated downstream of the filter chamber 211 is branched at the filter chamber 211 into two ink supply passages 210*a* and 210*b*. A filter F is provided within the filter chamber 211.

The capping device 215 includes a rubber cap 230 for sealingly covering the print surface of the print head 203. A partitioning wall 215*a* partitions a space within the rubber cap 230 into two cavities 217 and 218. Those two cavities 217 and 218 are capable of independently sealing the nozzle orifice groups G1 and G2 coupled respectively to the branch passages 210*a* and 210*b*. The cavities 217 and 218 have ink absorption ports 217*a* and 218*a*, respectively. Ink absorbing members 23 formed of porous material are put in the cavities 217 and 218.

Figure 18:
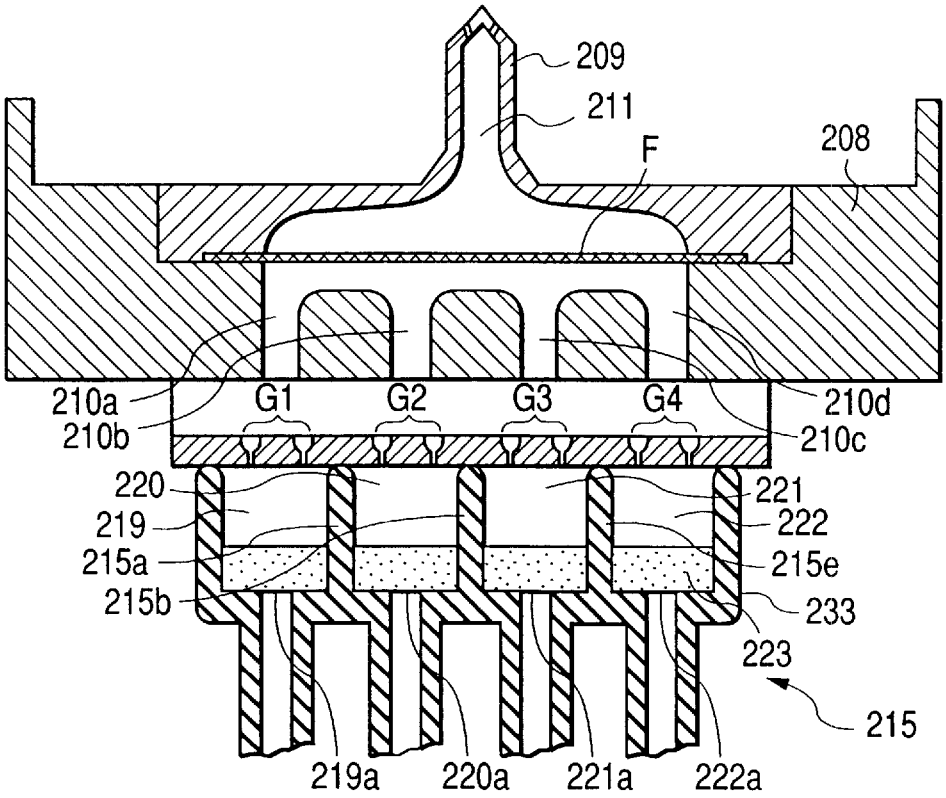
FIG. 18 is a cross sectional view showing another capping device.
Figure 19:
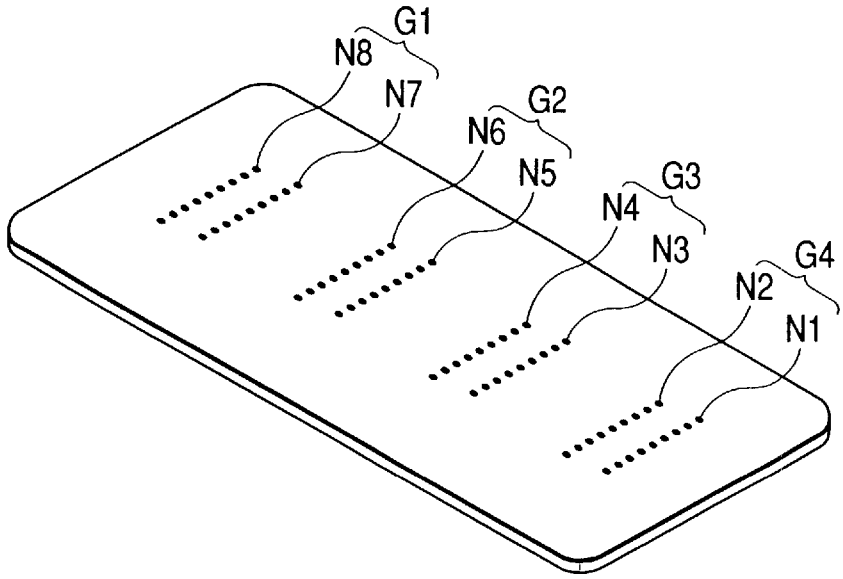
FIG. 19 is a perspective view showing a print surface of the print head to which the FIG. 18 capping device may be applied.

FIG. 18 is a cross sectional view showing another capping device 215. FIG. 19 is a perspective view showing a print surface of the print head 203 to which the capping device 215 may be applied.

As shown, orifices are arranged into four linear orifice arrays N1 to N8 on the print surface of the print head 203. Those linear orifice arrays N1 to N8 are further arranged into four nozzle orifice groups G1 and G4. To supply ink from one needle tube 209 to the two nozzle groups G1 and G4, the ink supply passage 210 situated downstream of the filter chamber 211 is branched at the filter chamber 211 into four ink supply passages 210*a* to 210*d*. A filter F is provided within the filter chamber 211.

The capping device 215 is provided with a rubber cap 233. A space within the rubber cap 233 is separated into four cavities 219 to 222 by partitioning walls 215*a* to 215*d*. Those four cavities 219 to 222 are capable of independently sealing the four nozzle orifice groups G1 to G4 coupled to the branch passages 210*a* to 210*d*. Those cavities have ink absorbing ports 219*a* to 221*a,* respectively. Ink absorbing members 223 formed of porous material are put in the chambers 219 to 222.

Figure 20A:
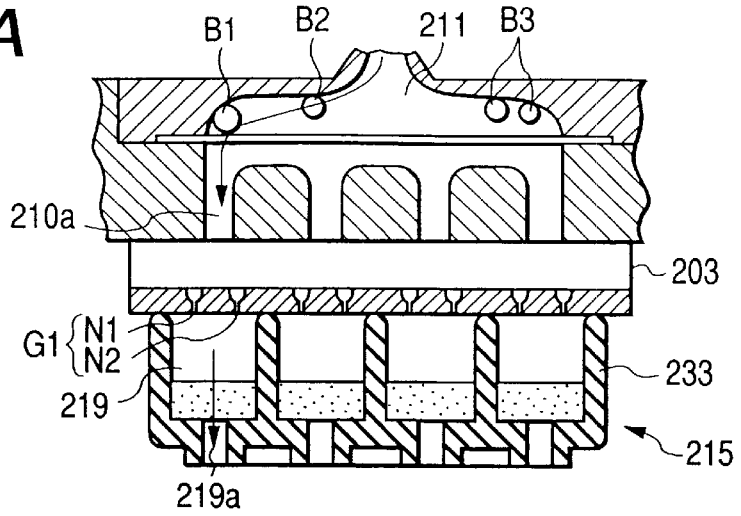
FIGS. 20A to 20C are cross sectional views for explaining the operations of the FIG. 18 capping device.
Figure 20B:
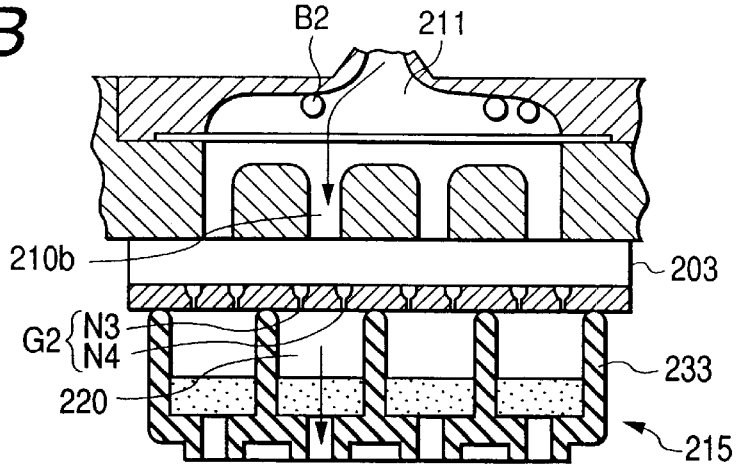
Figure 20C:
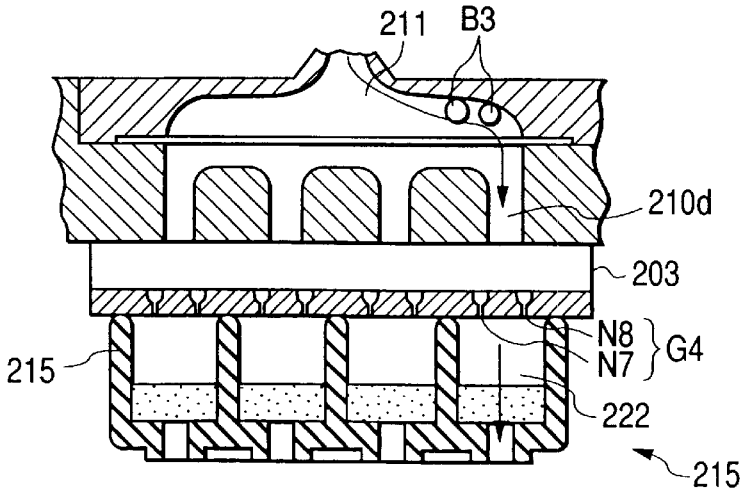

FIG. 20 is a cross sectional view for explaining the operation of the FIG. 18 capping device 215. The operation of the capping device 215 will be described hereunder.

In the case of a first loading or replacement of the ink tank 202, air is pressed into the needle tube 209 through a cylinder-piston action by the ink supply port 213 of the ink tank 202 and the needle tube 209. To discharge the air, the rubber cap 233 of the capping device 215 is applied to the print surface of the print head 203; negative pressure is applied to only the cavity 219 situated at the end of a train of cavities 219 to 222, through the ink absorbing port 219*a;* and the operation of sucking the first nozzle group G1 starts. In turn, as shown in FIG. 20A, ink flows from the filter chamber 211 into the branch passage 210*a,* and an air bubble B1 staying at a location near the branch passage 210*a* is moved to the print head 203. The air bubble having flowed into the print head 203, together with ink, is discharged to the cavities 219 of the rubber cap 233 through the nozzle group G1.

After the suction of the nozzle group G1 continues for a preset period of time, the supply of negative pressure to the cavity 219 is stopped. A negative pressure is supplied to the next cavity 220, and the operation of sucking the second nozzle group G2 commences. In turn, as shown in FIG. 20B, ink flows from the filter chamber 211 into the second branch passage 210*b,* and an air bubble B2 staying at a location near the branch passage 210*b* within the filter chamber 211 is moved to the second branch passage 210*b,* and discharged into the rubber cap 233 via the print head 203.

Following the suction for the second nozzle group G2, the suction for the third nozzle group G3 is performed (not shown), and finally the suction for the fourth nozzle group G4 is performed. In the final suction operation, negative pressure is applied to only the fourth cavity 222 of the rubber cap 233, and ink flows from the filter chamber 211 into the fourth branch passage 210*d.* Then, an air bubble B4 staying near the fourth cavity 222 within the filter chamber 211 goes to the fourth branch passage 210*d,* and discharged out via the print head 203.

Thus, negative pressure is sequentially supplied to the chambers of the capping device, so that quick flow of ink are sequentially created in the branch passages. With the ink quick flow, the air bubbles staying near the branch passages are individually and sequentially discharged, and as a result, the air bubbles within the whole filter chamber 211 are discharged.

Figure 22:
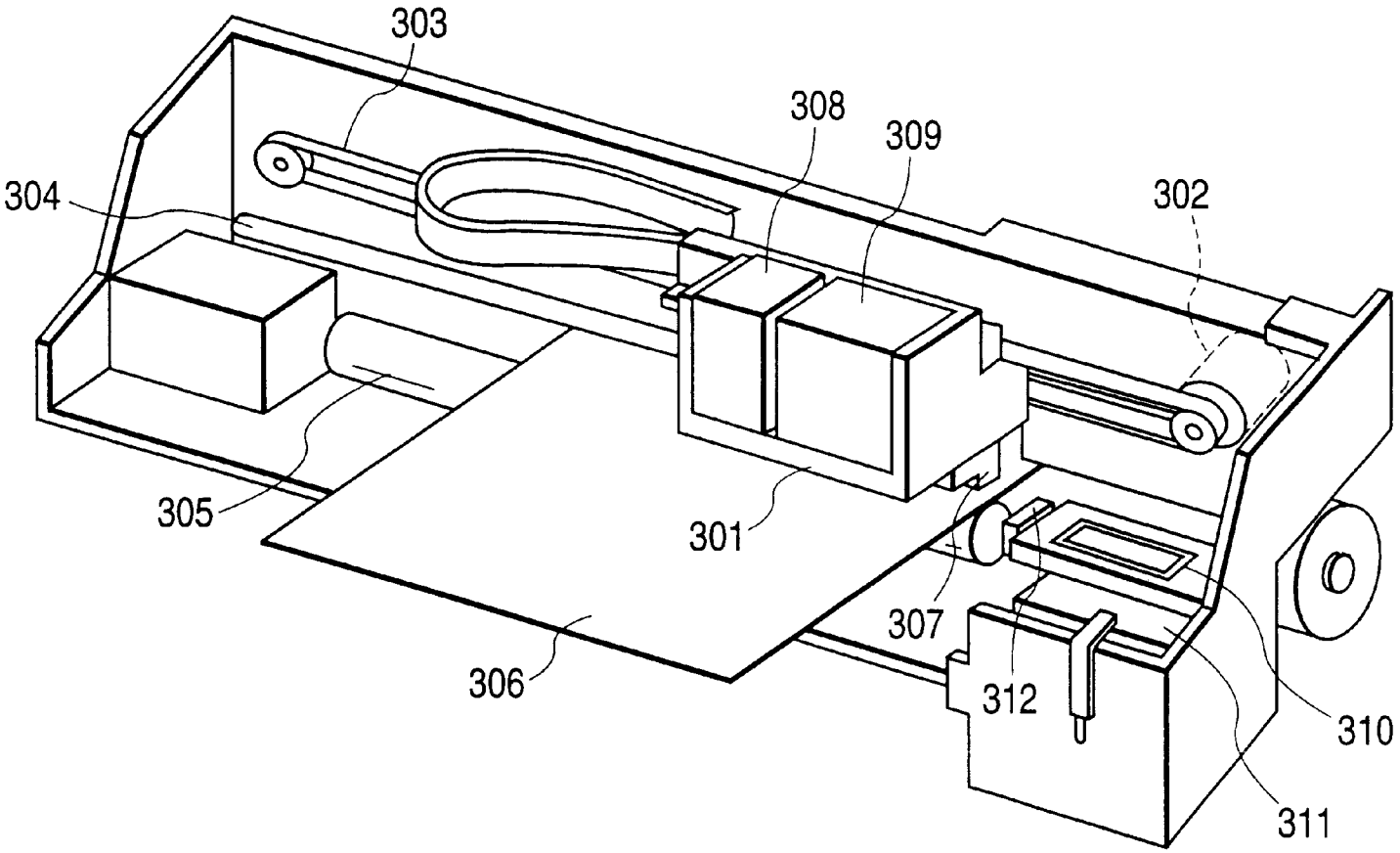
FIG. 22 is a front view of a ink jet recording apparatus according to the present invention.

FIG. 22 shows an entire ink jet recording apparatus according to the present invention in a perspective view. In the drawing reference numeral 301 denotes a carriage. This carriage 301 moves back and forth in the axis direction of a platen 305, guided by a guide member 304 via a timing belt 303, which reciprocates by driving force of a carriage motor 302.

Recording head 307 is mounted on the side of the carriage 301 facing recording paper 306. Also, a black ink cartridge 308 and a color ink cartridge 309 for supplying ink for the recording head 307 are mounted removably on the upper part of the carriage 301.

In the drawing reference numeral 310 denotes capping means arranged in a non-print section. The capping means is made in a size so that it can seal each nozzle opening formed on the nozzle plate of said recording head 307, which will be described later. A suction pump 311 is disposed below the capping means 310, for applying negative pressure to the capping means 310.

Said capping means 310 can move up and down along with the movement of the carriage 301 to the non-print section. The capping means functions as a cover to prevent the nozzle openings from drying during rest time of the recording apparatus and also as ink saucer during the flushing operation for discharging ink droplets with applying a driving signal unrelated to printing to the recording head. Further, the capping means also functions as cleaning means for absorbing ink through each nozzle openings of the recording head 307 with applying negative pressure from said suction pump 311 to the recording head 307.

A wiping member 312 made of elastic plate such as rubber is disposed adjacent to said capping means 310. The wiping member projects into the moving path of the recording head as the need arises and wipes the nozzle plate of the recording head 7 with the capping means 310 after absorbing ink.

Figure 23:
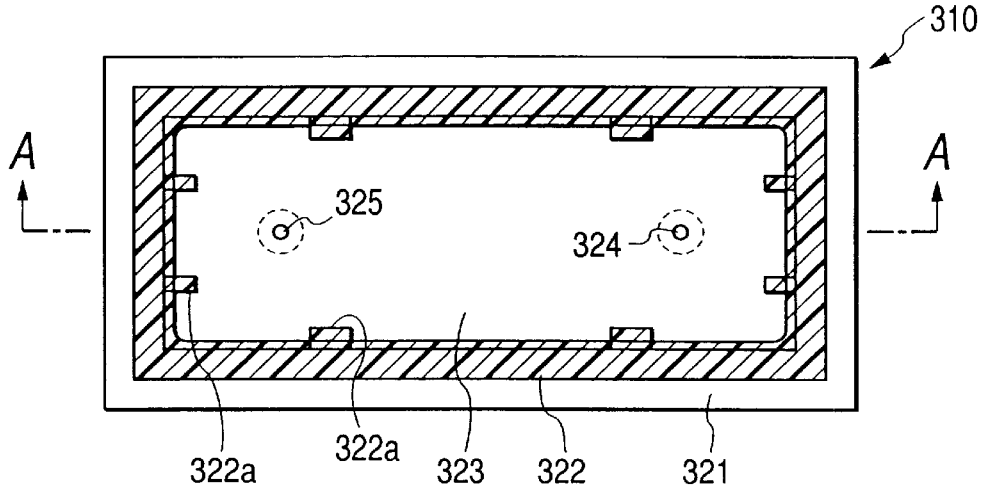
FIG. 23 is a top view showing a state observing capping means from the top.
Figure 24:
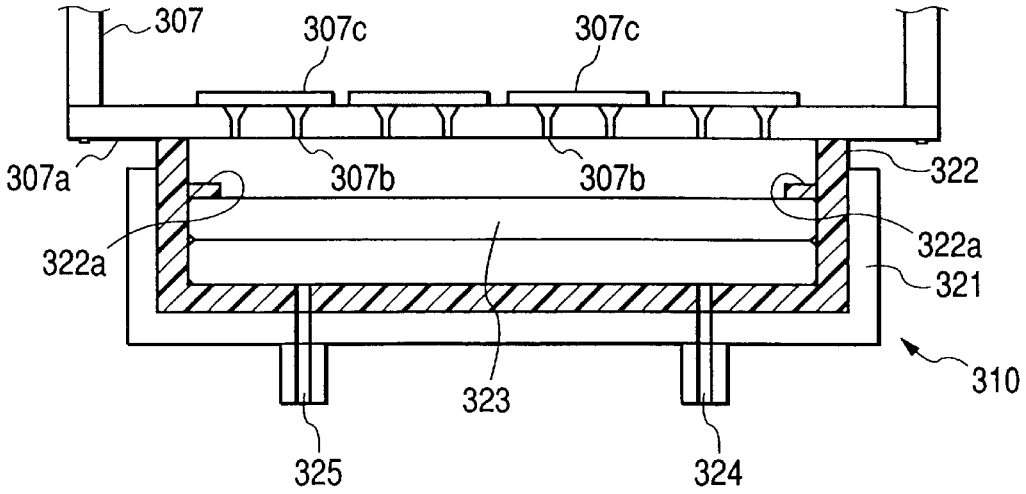
FIG. 24 is a sectional view of capping means observing A—A line in the direction of an arrow as shown in FIG. 23.

FIG. 23 shows a state viewing said capping means 10 from the top. FIG. 3 shows a section of the capping means 310 observing the A—A line in the direction of the arrow as shown in FIGS. 23 and 24 also shows a state that the capping means 310 seals the recording head 307 in a section view.

In FIG. 22 and FIG. 23, the capping means 310 is composed of a capping case 321 whose top is open and square shape and a capping member 322 formed integrated within the capping case 321 and made of an ink-resistant elastic member in a cup shape. Said capping member 322 is constructed in a state that the upper edge of the capping member projects a littler further than the capping case 321.

An ink absorbing member 323 is housed in the inner bottom of the capping member 322, made of porous material with superior ink-resistance and ink absorption. This ink absorbing member 323 is held inside of the capping member 322 by a plurality of holding part 322*a* formed integrated with the capping member 322 and projecting in the horizontal direction.

An ink suction port 324 and an air opening 325 are arranged at the bottom of said capping case 321 and said capping member 322, penetrating the capping case 321 and the capping member 322. Said ink suction port 324 and said air opening 325 are disposed along near the center in the longitudinal direction of the capping means and keeping a predetermined distance each other, when viewing the capping means 310 from the top side. The ink suction port 324 connects with said suction pump 311 via a tube (not shown). The air opening 325 also connects with an air valve via a tube (not shown).

On the other hand said capping means 310 ascends in response to the movement of the carriage to the non-print section, thereby the nozzle plate 307*a* of the recording head 307 is sealed as shown in FIG. 24.

Further, nozzle openings 307*b* are disposed in the recording head 307, through which black, cyan, magenta, and yellow inks are discharged respectively. Each ink is ejected by the operation of a piezoelectric vibrator 7*c* arranged corresponding to each nozzle opening 307*b*.

Therefore, closing an air valve connected with the air opening 325 of the capping means 310 and operating the suction pump 3011 connected with the ink suction port 324 make it possible to apply negative pressure within the capping member 322 of the capping means 310. Thereby, the cleaning operation is performed for absorbing ink through each nozzle opening 307*b* of the recording head 307.

Opening the air valve connected with the air opening 325 to operate the suction pump 311 enables discharged ink within the capping member 322 to be absorbed into the side of the suction pump 311, while enables absorbed ink to be discharged into a discharge ink tank (not shown).

Figure 25B:
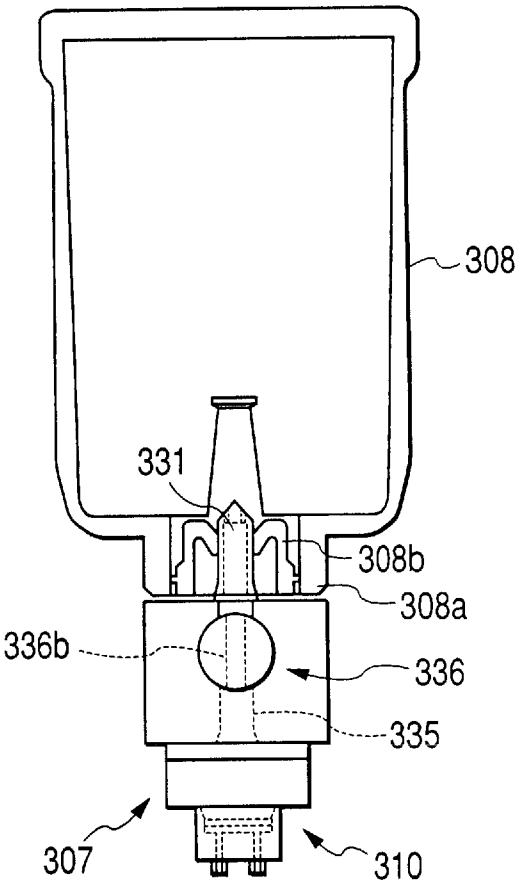
FIGS. 25(*a*) and (*b*) are sectional views showing construction of a valve unit arranged between a recording head and an ink cartridge.
Figure 25A:
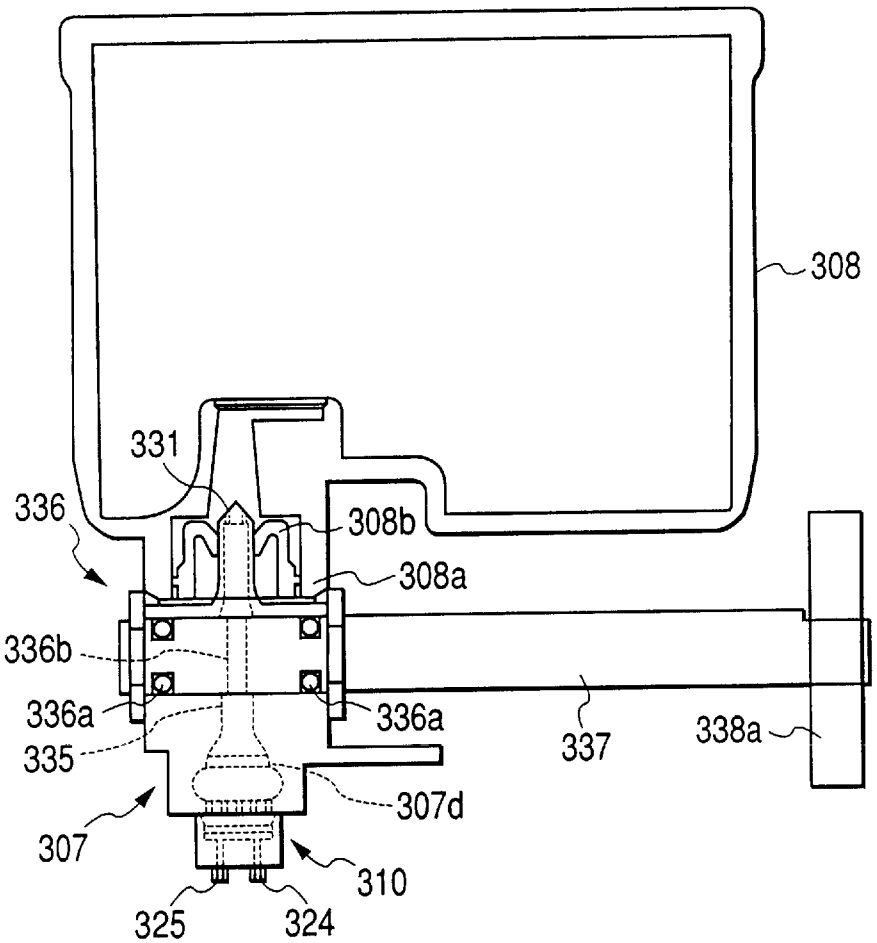

FIG. 25 shows the structure of the valve unit disposed between the recording head 307 and the ink cartridge (the drawing indicates a black ink cartridge 308). FIG. 25(*a*) and FIG. 25(*b*) illustrate a sectional view observing from the mutually orthogonal directions.

Figure 32:
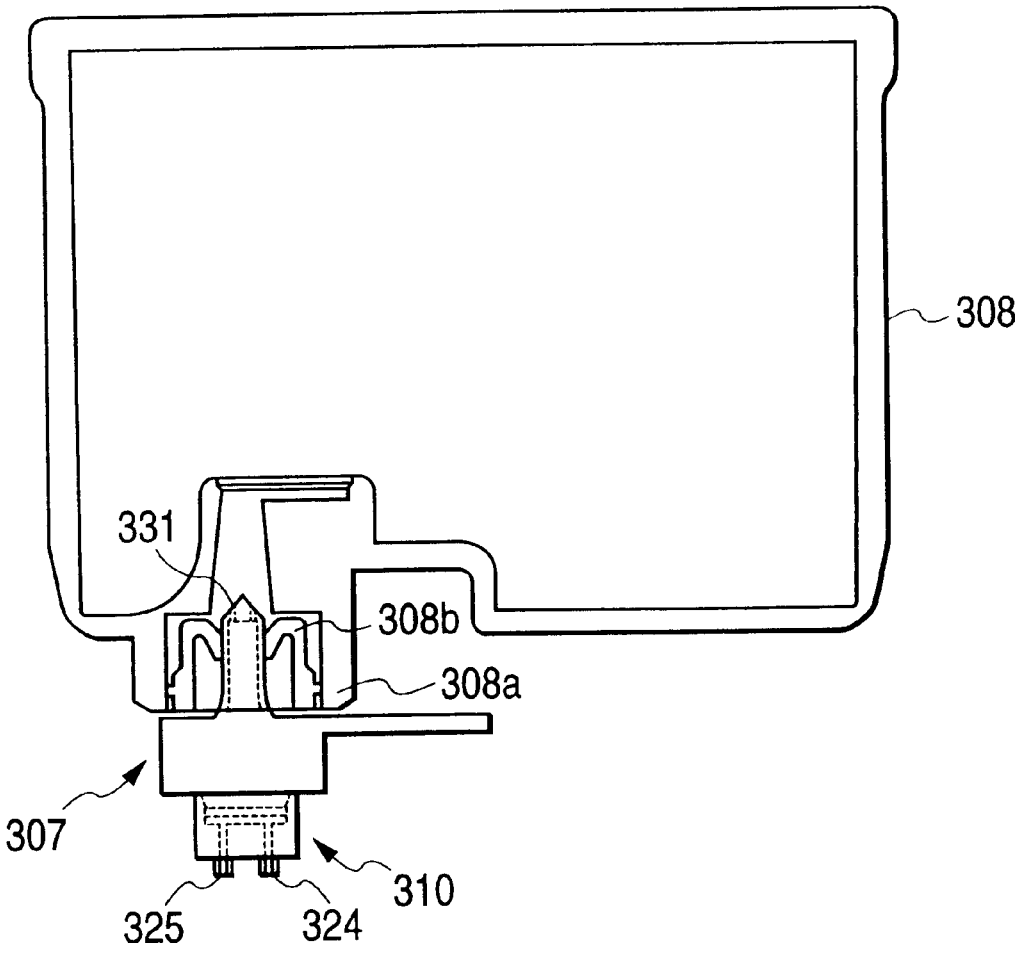
FIG. 32 is a sectional view showing an assembly state of the conventional ink cartridge, recording head and capping means.

FIG. 25(*a*) illustrates a state viewing from the same direction as usual structure shown in FIG. 32 already described. Corresponding parts are indicated with identical reference numerals. Therefore, description of said parts is omitted accordingly.

As shown in FIGS. 25(*a*) and (*b*), a valve unit 336 is disposed on the upper part of the recording head 307, for opening and closing an ink supply path 335 between the ink cartridge 308 and the nozzle openings of the recording head 307. This valve unit 336 enables a shaft 337 installed across the ink supply path 3335 to rotate and also to keep airtight condition by a pair of O-ring rubber 336*a*. In the part of the shaft 337 crossing the ink supply path 335, an ink connecting hole 336*b* is formed in the orthogonal direction of the axis of the shaft.

Consequently, rotating the shaft 336 and joining the connecting hole 336*b* and the ink supply path 335 together in a straight line, the valve unit 336 opens the valve. Positioning the connecting hole 335 and the ink supply path 335 inconsistent in a straight line, the valve unit 336 closes the valve.

Accordingly, said valve unit 336 is mounted on the carriage 301 together with the ink cartridge 308 and the recording head 307, and thus reciprocates along the guide member 304. The valve unit 336 is used to execute the above-described method of selectively sucking ink from the nozzle groups.

Further, a head filter 307*d* is arranged in the ink supply path 335 between said valve unit 336 and the nozzle openings of said recording head 307. This head filter 307*d* is positioned just under the valve unit 336 as shown in the drawing. The head filter prevents alien substances from entering into the recording head 307 when alien substances are generated due to rotation of the valve unit 336 and the like. Thereby the occurrence of printing disorder can be prevented.

Figure 26B:
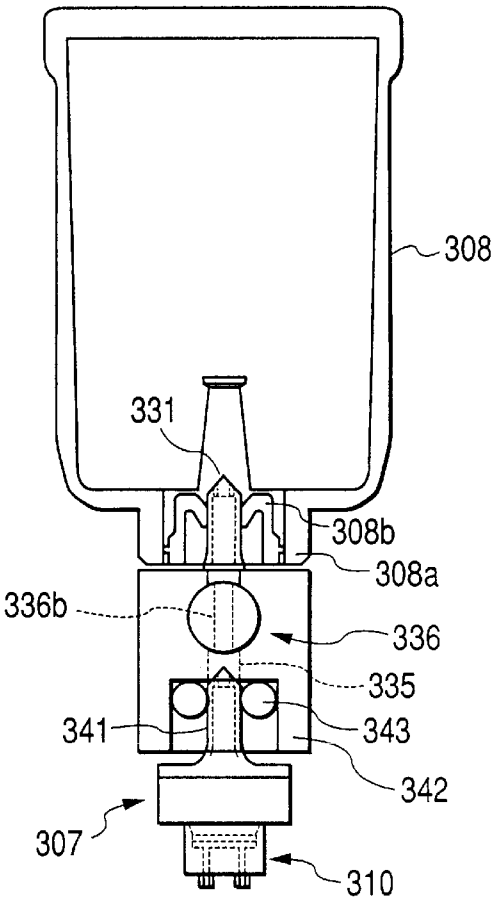
FIGS. 26(*a*) and (*b*) are sectional views showing another construction of a valve unit arranged between a recording head and an ink cartridge.
Figure 26A:
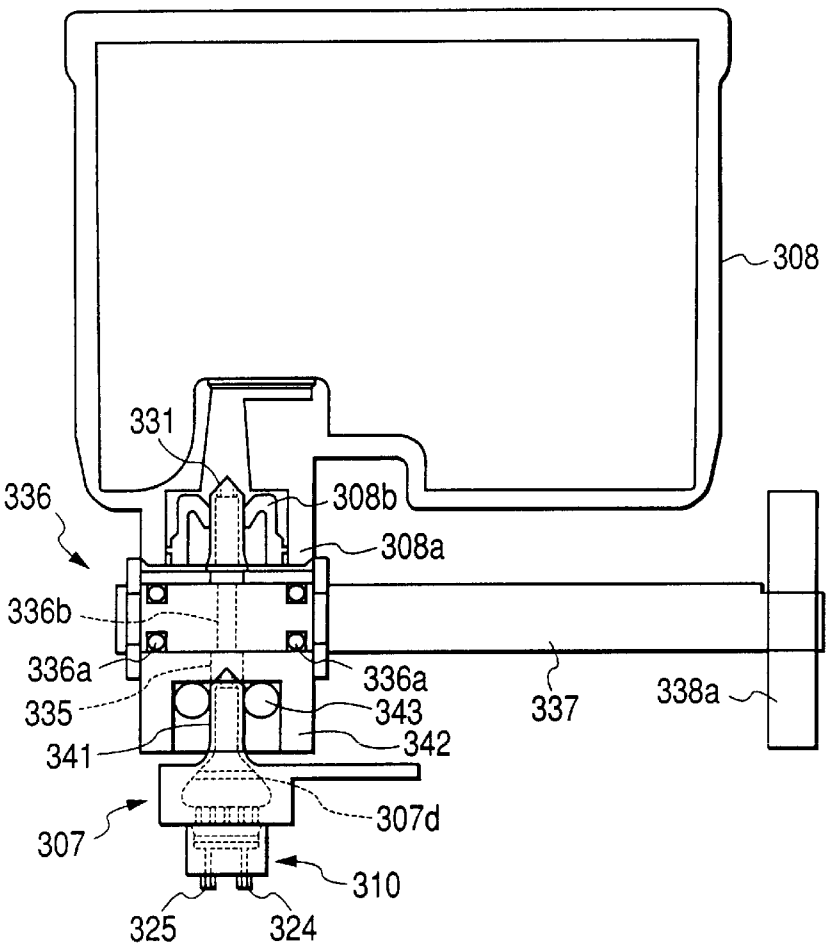

FIGS. 26(*a*) and (*b*) show a different embodiment wherein the arrangement of the valve unit 36 as shown in FIGS. 25(*a*) and (*b*) is modified a little. FIG. 26(*a*) and FIG. 26(*b*) illustrates a sectional view observing from the mutually orthogonal directions. The parts corresponding to FIGS. 25(*a*) and (*b*) are indicated with identical reference numerals. Therefore, description of said parts is omitted accordingly.

In the example shown in FIGS. 26(*a*) and (*b*), the valve unit 336 is formed as a separate body from the recording head 307. A hollow ink supply needle 31 connecting with the valve unit 336 is formed jointly on the upper part of the recording head 307. At the bottom of the valve unit a cylindrical section 342 is formed and O-ring shaped sealing member 343 is arranged within the cylindrical section 342 for enclosing the periphery of said ink supply needle 41. Therefore, the ink supply needle 41 formed on the upper part of the recording head 307 connects adherently with said sealing member 343, thereby ink is supplied into the recording head 7 from the valve unit 336.

The valve unit 336 shown in FIGS. 25(*a*) and (*b*) and FIGS. 26(*a*) and (*b*), for example, opens and closes the ink supply path 335 between the black ink cartridge 308 and the nozzle openings for black ink in the recording head 307. This valve unit is also arranged respectively in each supply path of cyan, magenta, and yellow inks, supplied from a color ink cartridge 309.

Figure 27:
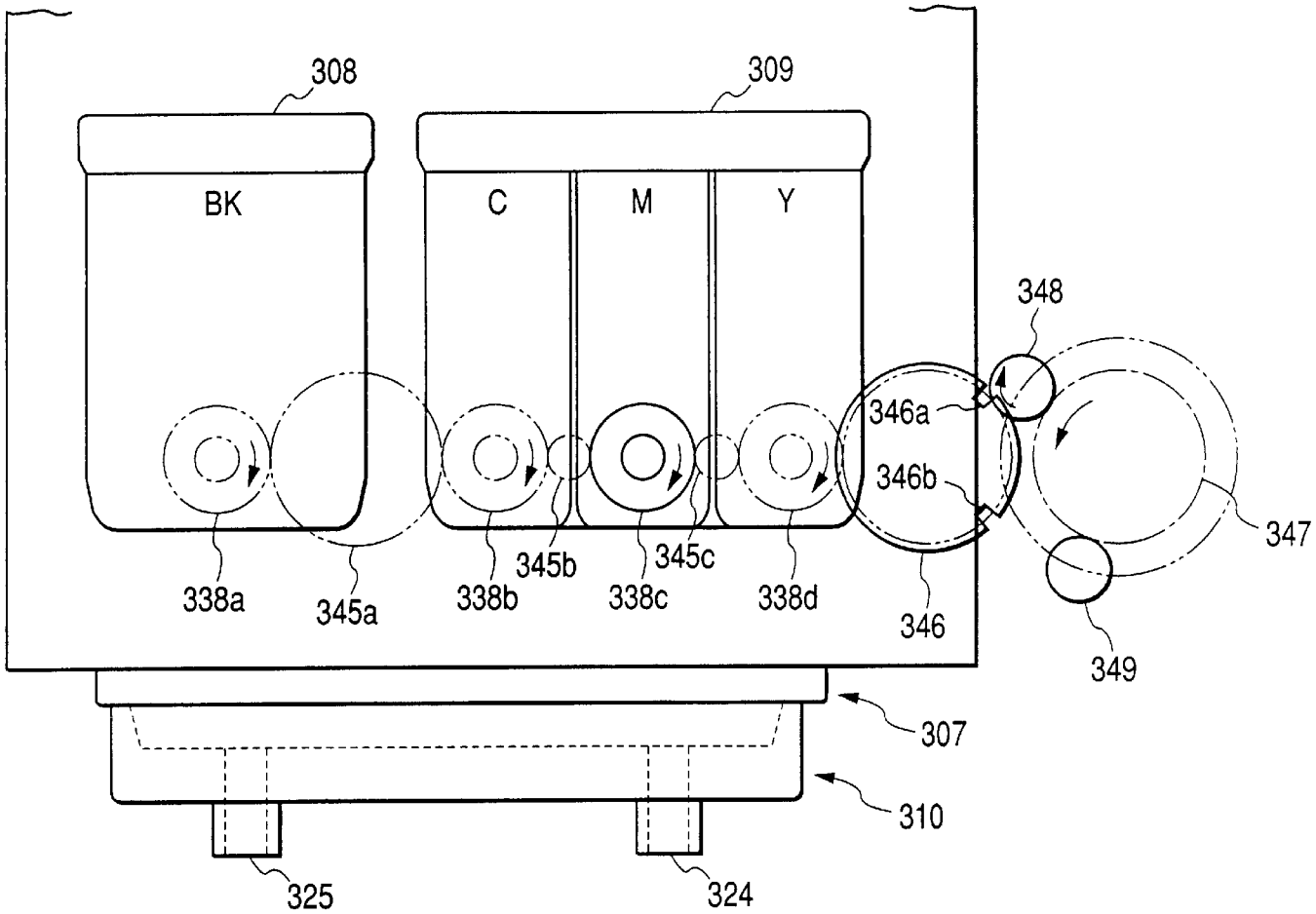
FIG. 27 is a front view showing an example of rotary drive mechanism for controlling opening and closing of each valve unit.

FIG. 27 shows the structure of the valve unit. Spur gears 338*a*, 338*b*, 338*c*, and 338*d* with same number of teeth connect with rotatable shaft 337 respectively for controlling opening and closing each valve unit arranged on each supply path of black, cyan, magenta and yellow ink. Connecting gears 345*a*, 345*b*, and 345*c* are arranged between the spur gears to connect said spur gears 338*a*, 338*b*, 338*c*, and 338*d*. Combination of these gears enables the shaft 337 of each valve unit to rotate synchronously.

The spur gear 338*d* for driving the valve unit arranged in the supply path of yellow ink engages with a partially teeth-lacked gear 346 with a pair of teeth-lacked parts 346*a* and 346*b*.

On the other hand, a driving gear 347 rotated reciprocating driven by a pulse motor as an actuator, always engages with two driven gears 348 and 349 as shown in the drawing. Those both driven gears 348 and 349 move in the rotating direction of the driving gear 347, keeping a predetermined angle each other as shown in the drawing based on the shaft center of said driving gear 347 (not shown).

Therefore, according to the direction in which the drive gear 347 rotates, either of said driven gears 348 or 349 engages with said partially teeth-lacked gear 346. Thereby turning force in the reciprocating direction of the driving gear 47 synchronizes with each spur gear 338*a*, 338*b*, 338*c*, and 338*d* for driving each valve unit, and cause to drive rotatively in the reciprocating direction.

FIG. 27 shows an initial state. Rotation of the driving gear 347 in the direction of an arrow causes the driven gear to rotate the partially teeth-lacked gear 346. Thus spur gears 338*a*, 338*b*, 338*c*, and 338*d* for driving each valve unit are rotated in the right direction as shown in FIG. 27. With the rotation continued, when the driven gear 348 reaches to the position of teeth-lacked part 346*b* formed on the partially teeth-lacked gear 346, engagement is released between the driven gear 348 and the partially teeth-lacked gear 346. This is the final state.

Figure 28:
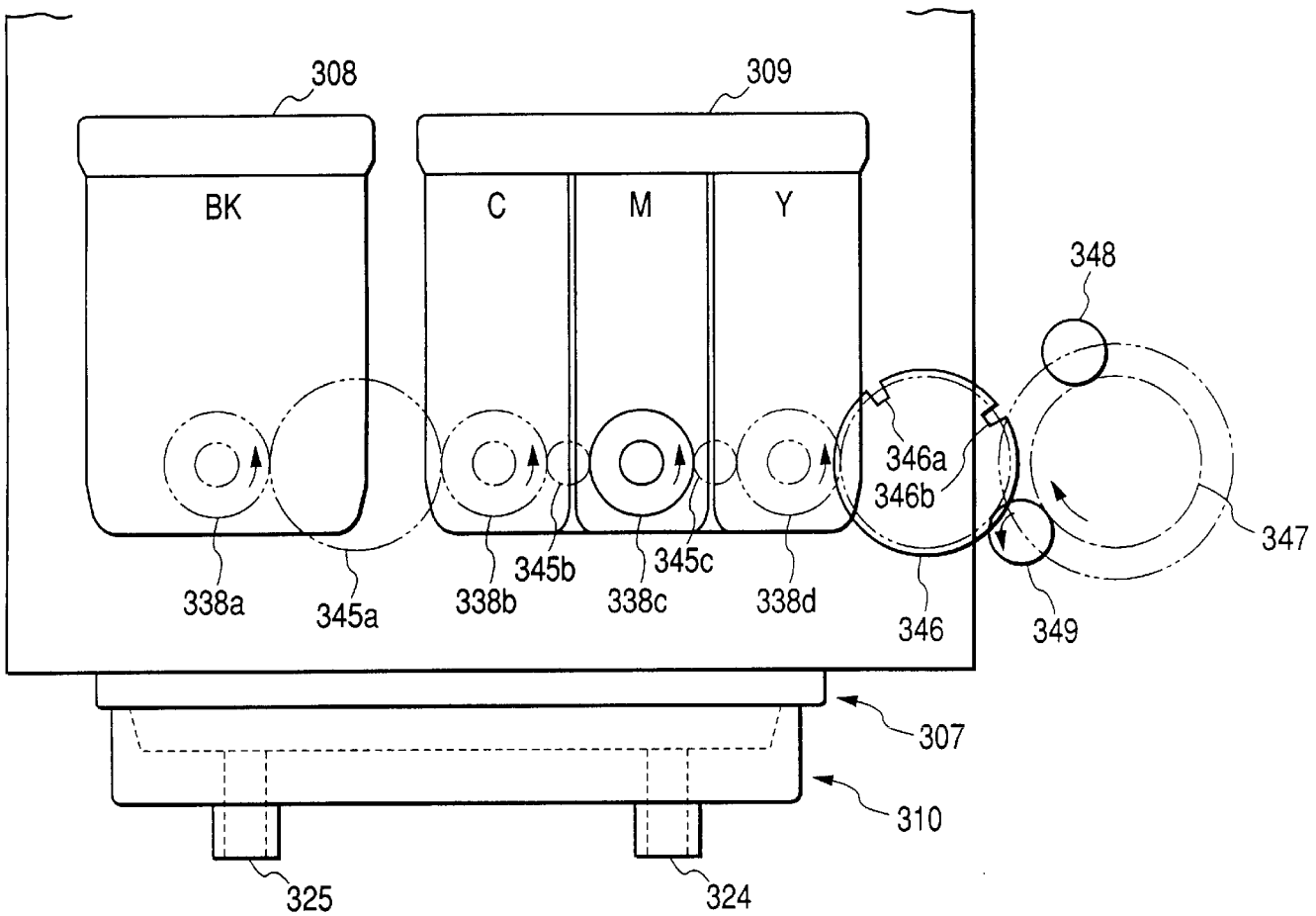
FIG. 28 is a front view showing a state driving rotary drive mechanism in the reverse direction.
Figure 29A:
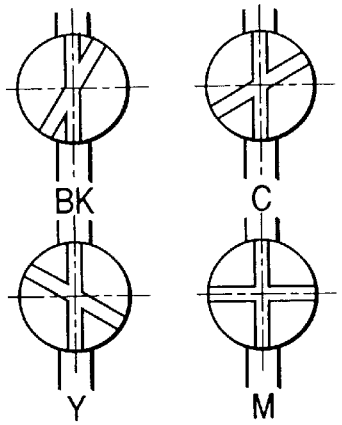
FIGS. 29(*a*)–(*f*) are type views showing opening and closing states of each valve unit.
Figure 29B:
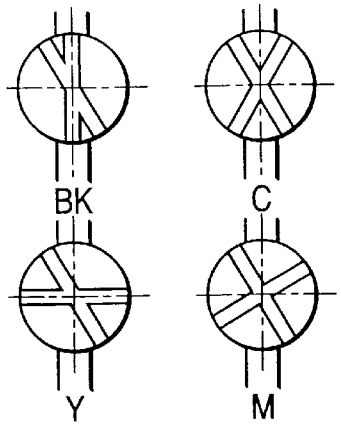
Figure 29C:
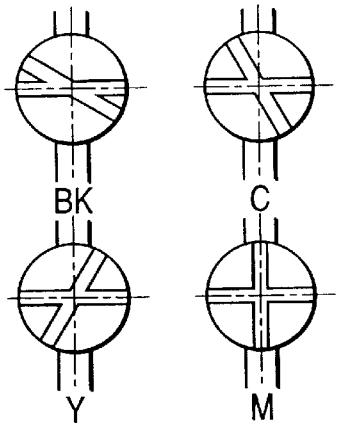
Figure 29D:
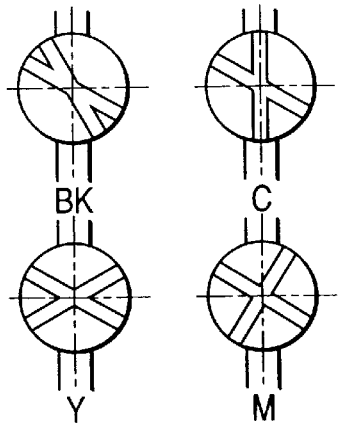
Figure 29E:
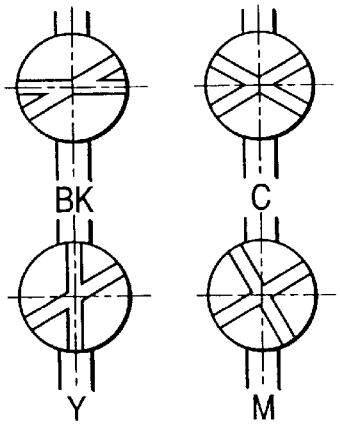
Figure 29F:
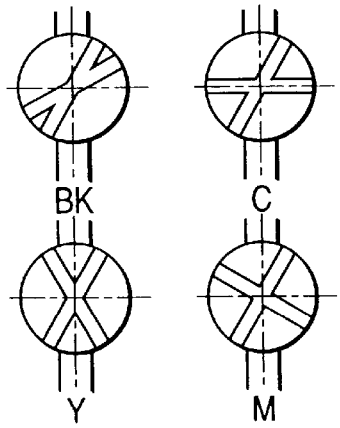

FIG. 28 shows the situation the final state turns back toward the initial state as shown in FIG. 27. Specifically, reverse drive of a pulse motor as an actuator rotates the driving gear 347 in the direction an arrow in FIG. 28. In accordance with this rotation, the driven gear 349 drives to rotate the partially teeth-lacked gear 346. Therefore, the spur gears 338*a*, 338*b*, 338*c*, and 338*d* for driving each valve unit are rotated in the left direction as shown in FIG. 28. With the rotation continued, the driven gear 349 reaches to the position of teeth-lacked part formed on the partially teeth-lacked gear 346, thus engagement is released between the driven gear 348 and the partially teeth-lacked gear 346. This is the initial state.

FIG. 29 shows the opening and closing operation of each valve unit in order, performed by the driving operation as shown in FIG. 27 and FIG. 28. Namely, each valve unit located in each supply path of black, cyan, yellow, and magenta inks is indicated as BK, C, Y, and M. Connecting holes in each valve unit are illustrated in solid lines inside of the circles.

Further, as shown in FIG. 29, each valve unit has a shaft disposed across the ink supply path. A pair of connecting holes penetrate in the orthogonal direction of the axis of the shaft. Namely, a pair of ink connecting holes cross in X shape. Selecting a proper cross angle as shown in FIG. 27, combination mode of each valve unit for opening and closing, which will be described later, is efficiently achieved.

First, (a) in FIG. 29 shows the initial state indicated in FIG. 27, which illustrates full-open mode wherein all valve units are open. Next, the state of (b) formed by the rotation of each unit shows an alternative open valve mode wherein only black valve unit is open. Further, the state of (c) formed by the rotation of each valve unit indicates an alternative open valve mode wherein only magenta valve unit is open. Furthermore, the state of (d) formed by the rotation of each valve unit shows an alternative open valve mode wherein only cyan valve unit is open. And the state of (e) formed by the rotation of each valve unit indicates an alternative open valve mode wherein only yellow valve unit is open. Finally, in the final state shown in FIG. 28, a full-closed mode is performed wherein all valve units are closed as shown in (f).

Thus, driving the driving gear 347 as shown in FIG. 27 and FIG. 28 to rotate in the reciprocal directions by a pulse motor as an actuator, all modes for opening and closing of valve units can be selected as shown in FIG. 29.

Controlling the number of driving pulses provided the pulse motor for controlling opening and closing the valve units, each mode as shown from (a) through (f) in FIG. 29 can be selected.

Figure 30:
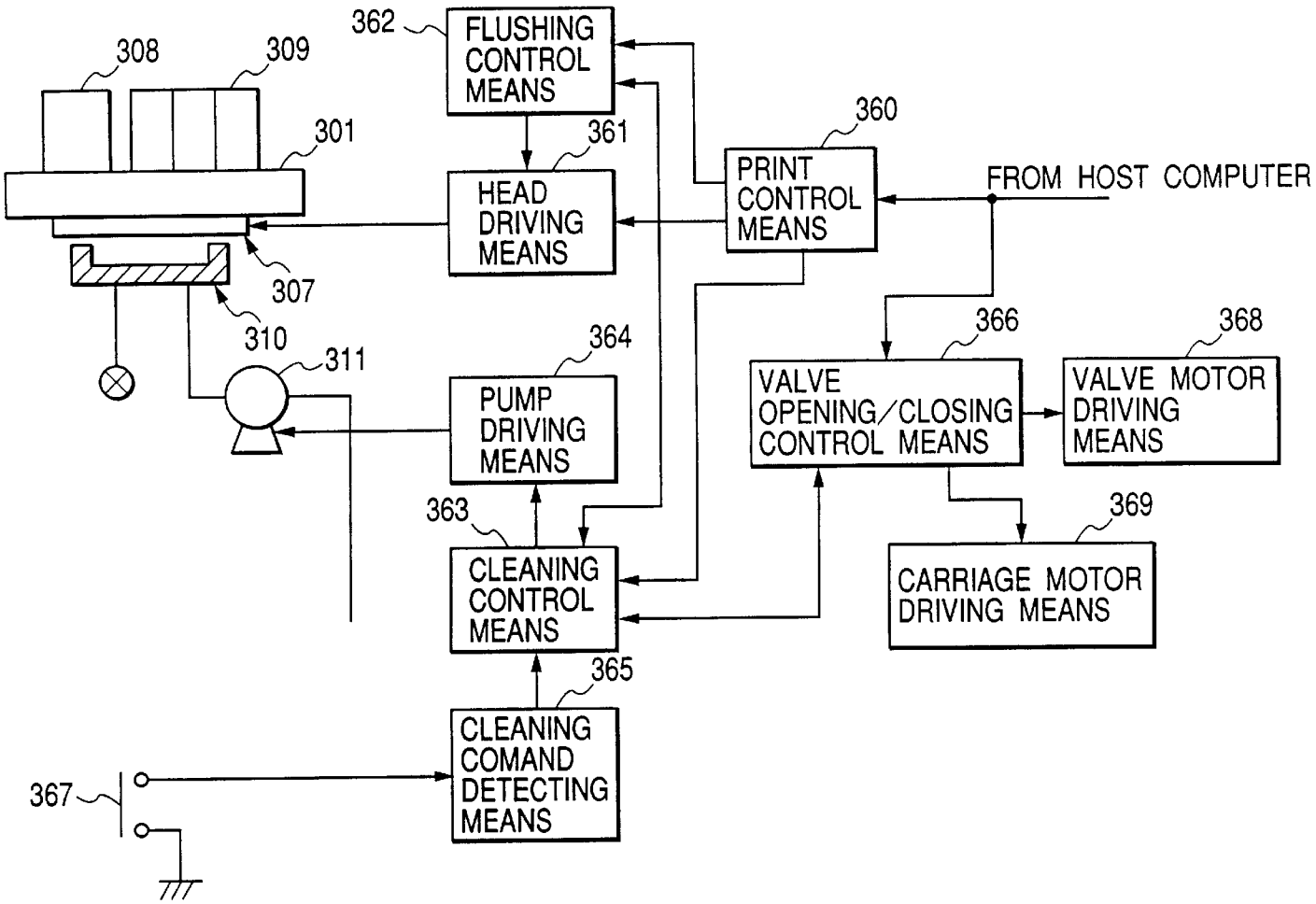
FIG. 30 is a block diagram showing an example of a control circuit contained in the recording apparatus according to the present invention.

FIG. 30 shows an example of a control circuit mounted on the recording apparatus with the above-mentioned structure. In FIG. 30 the recording head 7, the ink cartridges 308 and 309, and the suction pump 311 are indicated with the same reference numerals as already described. Therefore, the descriptions will be omitted.

The reference numeral 360 in FIG. 30 denotes print control means for generating bit map data on the basis of print data from a host computer of the recording apparatus. A head driving means 361 generates drive signals in accordance with the bit map data and discharge ink from the recording head 307. The head driving means 361 receives flushing command signals from flushing control means 362 in addition to the drive signals based on the print data, so as to output drive signals for the flushing operation into the recording head 307.

The reference numeral 363 denotes cleaning control means. The instruction of the cleaning control means 363 operates pump driving means 364 so as to control driving of the suction pump 311. The cleaning control means 363 is provided with cleaning command signals from the print control means 360, cleaning instruction detecting means 365, and valve opening/closing control means 366.

A command switch 367 is connected with the cleaning instruction detecting means 65. When the user push on this switch 367, said instruction detecting means 365 operates, thereby the manual cleaning operation is performed.

Receiving a status signal from the host computer, said valve opening/closing control means 366 sends control signals to said cleaning control means 63, valve motor driving control means 368, and carriage motor control means 369.

Said valve motor driving means drives the pulse motor as shown in FIG. 27 and FIG. 28 for driving the driving gear 347 in the reciprocal directions. The carriage motor control means 369 drives the carriage motor 302 as shown in FIG. 22 to move the carriage 301 to the non-print section and controls the capping means 310 to seal the recording head 307.

Figure 31:
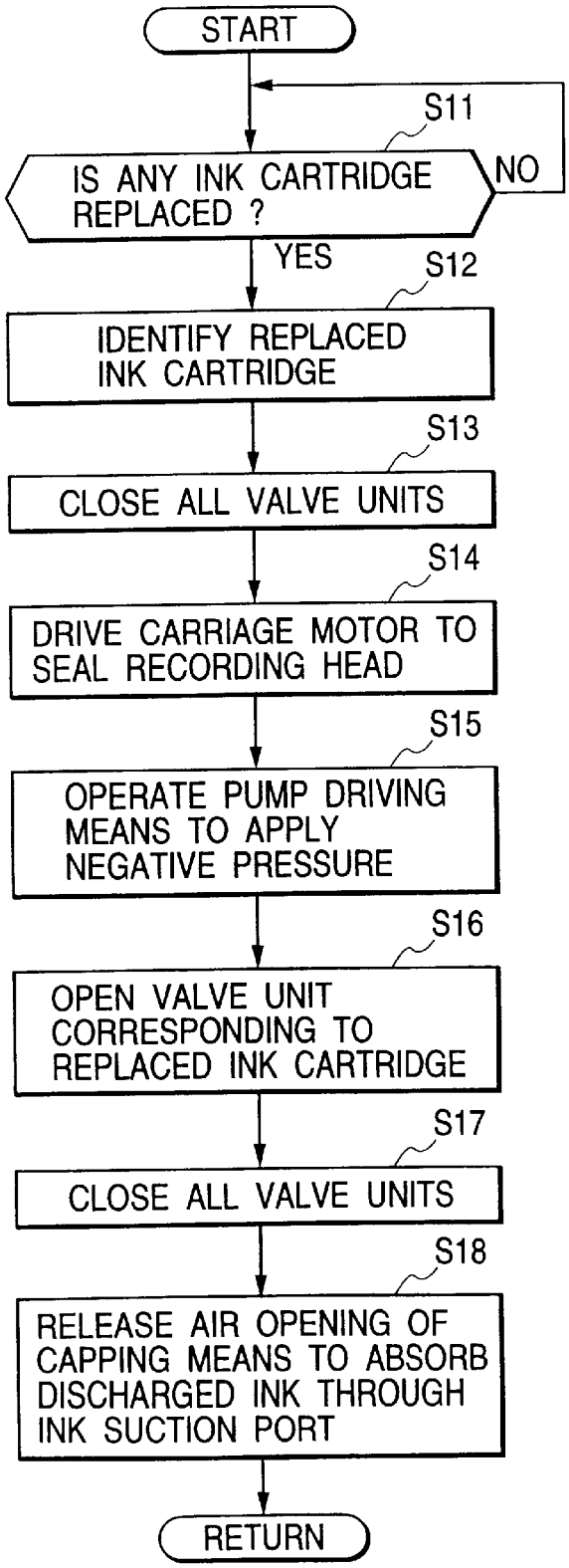
FIG. 31 is a flowchart showing an example of control sequence of the head cleaning operation performed in the recording apparatus according to the present invention.

Next, a sequence of the cleaning control of the recording head in the ink jet recording apparatus with a construction described above, will be described based on a flow chart as shown in FIG. 31. FIG. 31 shows an example of a control sequence of the cleaning operation for replacement executed, for example, when an ink cartridge is replaced.

First, when either of ink cartridges, i.e. the black ink cartridge 308 or the color ink cartridge 309, is replaced, a leaf contact (not shown) arranged in a cartridge holder becomes ON state, thereby the replacement of ink cartridge 308 or 309 is detected. The valve opening/closing control means 366 as shown in FIG. 30 judges this fact by reading status data of the host computer.

Step S11 as shown in FIG. 31, said valve opening/closing control means regularly read status data from the host computer in order to monitor whether or not either of ink cartridges is replaced. When it is judged that an ink cartridge is replaced, step S11 moves to step S12 to identify which ink cartridge is replaced. In this step S12, the valve opening/closing control means 366 reads and recognizes status data of the host computer.

When the valve opening/closing control means 366 recognizes that an ink cartridge is replaced, step S12 moves to step S13, wherein the valve opening/closing control means 66 sends a command signal to the valve motor driving means 368. Thus, all valve units are closed. Driving pulses are sent to said pulse motor for controlling opening/closing each valve unit to achieve a state as shown in FIG. 29(*f*), thereby all valve units are closed.

Moving to the next step S14, the carriage motor is driven to seal the recording head. The valve opening/closing control means 66 as shown in FIG. 30 sends control signals to the carriage motor driving means 369. The carriage motor 302 is driven in accordance with the signal and moves the carriage 301 to just above the capping means 310 disposed in the non-print section.

In step S15, the pump driving means operates to apply negative pressure. In FIG. 30 the valve opening/closing control means 366 sends command signals to the cleaning control means 363, thus the cleaning control means 363 operates the pump driving means 364 to drive the suction pump 311. Consequently, negative pressure is applied within the capping means 310, which makes the nozzle plate of the head in a capping state.

Moving to the next step S16, the valve unit corresponding to the replaced cartridge is opened. In this case, the valve opening/closing control means 366 has already known which cartridge was replaced. For instance, if a black ink cartridge is replaced, alternative valve open mode is selected, wherein only black ink valve unit is open, as shown in FIG. 29(*b*).

Accordingly, air bubbles entered into the recording head at the time of replacement of the black ink cartridge are discharged through the nozzle openings during ink suction. Then, sufficient negative pressure is applied in advance within the capping means in step S15. The air bubbles move rapidly within the head in response to quick ink suction and are discharged immediately through the nozzle openings. Thereby, all air bubbles can be discharged by small volume of ink suction. When the color ink cartridge 9 is replaced, the state as shown in FIGS. 29(*c*), (*d*), and (*e*) is achieved. Specifically, the alternative valve open mode wherein only the valve unit for magenta ink is open, the alternative valve open mode wherein only the valve unit for cyan ink is open, and the alternative valve open mode wherein only the valve unit for yellow ink is open, are selected in order. At the same time, air bubbles are discharged from the head in response to ink suction respectively.

In the following step S17, all valve units are closed. Namely, full-close mode is realized as shown in FIG. 29(*f*). Thereby, in disposing discharged ink executed in the next step S18, destruction of meniscuses formed at the nozzle openings of each head is prevented.

In step S18, the air opening of the capping means is opened and discharged ink is absorbed through the ink suction port. Specifically, said air valve is opened, which connects with the air opening 325 arranged in the capping means 310, to drive the suction pump 311 connecting to the ink suction port 324. Thus discharged ink within the capping means 310 in step S16 is discharged into a discharge ink tank.

Then, opening of said air valve produces foamy ink within the capping means 310, and ink foam adheres to the nozzle plate of the recording head 307. Since all valve units are closed in step S17, ink foam is prevented from entering the nozzle openings. Consequently, the destruction of meniscuses formed at the nozzle openings is prevented. Because the passage volume which acts upon negative pressure of the nozzle hole with the closed valves is very small, the volume of withdrawn ink is extremely small and is recovered easily by such as flushing.

The foregoing is an explanation of the cleaning operation for replacement, when either of ink cartridges is replaced. During the manual cleaning operation when the user turns on the command switch 367 and during the cleaning operation instructed automatically by the print control means 360 after a predetermined time is passed from the last cleaning operation, the cleaning control means 363 sends a command signal to the valve opening/closing control means 366.

In this case, the valve opening/closing control means 66 sends a control signal to the valve motor driving means 368 and the carriage motor control means 369 as described above. At this time, the valve motor driving means 368 selects the full-open mode for opening all valve units as shown in FIG. 29(*a*) and causes all nozzle openings to discharge ink.

Although it is not particularly shown in the drawings, when poor discharge(missing dots) occurs in a specific ink, providing with the operation switch for opening the valve unit corresponding to the nozzle openings enables the cleaning operation to be performed in accordance with the specific nozzle openings.

In the embodiment described above, a ink jet recording apparatus is shown using black ink and three different color inks. For example, in a recording apparatus only using monochrome black ink, also arranging a valve unit makes it possible to facilitate the air bubble discharging operation during the cleaning operation for replacement.

Also, without having a pulse motor separately for driving each valve unit, for example, sharing with a paper feed motor for conveying recording paper is possible. Further, in the embodiment each valve unit is constructed to drive and rotate with interlocking each other. However, even if each valve unit is structured to control opening/closing independently, the same effect can be obtained.

While the preferred embodiments of the present invention have been described using specific terms, such description is for illustrative purposes only, and it should be understood that changes and variations may be made within the scope of the invention defined in the claims.

A process that a user locates a clogged nozzle by the utilization of a printed clogging check pattern, and specifies the clogged nozzle on a clogging check pattern on a display screen of the host computer in connection with the clogged nozzle located, which is applied to the ink jet printer in the embodiments mentioned above, may be applied to serial printers, such as wire impact dot printers and thermal transfer printers. In this case, the process is used for locating a defective dot forming element.

What is claimed is:

1. An ink jet recording apparatus comprising:

ink jet recording heads including nozzle openings for discharging different color ink droplets through said nozzle openings upon receiving ink from ink cartridges;

capping means for sealing each of said nozzle openings to absorb ink through the nozzle openings;

a plurality of valve units arranged between said ink cartridges and each of said nozzle openings for opening and closing ink supply paths between the ink cartridges and said nozzle openings; and a valve opening/closing control unit which controls said valve units to open and close valves during a cleaning operation to absorb ink through selected nozzle openings of the nozzle openings, wherein said valve opening/closing control unit selectively performs a full-open mode for opening all of said valve units, a full-close mode for closing all of said valve units, and an alternative open mode for opening only one of said valve unit units alternatively.

2. An ink jet recording apparatus as claimed in claim 1, wherein each of said valve units interlocks with a rotational drive of an actuator to select one mode from said full-open mode, full-close mode, and alternative open mode.

3. An inkjet recording apparatus as claimed in claim 1, wherein said ink supply paths include black, cyan, magenta and yellow ink supply paths, and said valve units are arranged in said black ink supply path, said cyan ink supply path, said magenta ink supply path, and said yellow ink supply path, respectively.

4. An ink jet recording apparatus as claimed in claim 1, wherein said valve units are mounted on a carriage together with said ink cartridges and said recording head, and reciprocate along a guide member.

5. An ink jet recording apparatus as claimed in claim 1, wherein head filters are disposed in the ink supply paths between said valve units and said nozzle openings of the recording head.

6. An ink jet recording apparatus as claimed in claim 1, wherein said valve units are arranged such that at least a pair of ink connecting holes penetrate crossing an axis direction of a shaft, disposed across said ink supply paths.

7. An ink jet recording apparatus as claimed in claim 1, wherein said capping means is formed with a single capping member capable of sealing all of said nozzle openings for discharging different color inks respectively.

8. An inkjet recording apparatus comprising:

a ink jet recording head for discharging ink droplets through nozzle openings of said ink jet recording head upon receiving ink supply from an ink cartridge;

capping means for scaling said recording head to absorb ink through the nozzle openings;

a pump unit for applying negative pressure to said capping means;

a valve unit arranged between said ink cartridge and said nozzle openings of the recording head for opening and closing an ink supply path between the ink cartridge and the nozzle openings; and valve opening/closing control means for controlling opening and closing of said valve unit, wherein said valve opening/closing control means operates said valve unit to prevent ink from flowing from said ink cartridge to all of said nozzle openings at a first time, wherein said capping means seals said recording head and said pump unit applies said negative pressure at a second time alter said first time, wherein said valve opening/closing control means operates said valve unit to allow in to flow from said ink cartridge to said nozzle openings at a third time after said second time and while said capping means seals said recording heads, wherein said valve opening/closing control means operates said valve unit to prevent ink from flowing from said ink cartridge to all of said nozzle openings at a fourth time after said third time, and wherein said pump unit applies negative pressure to the capping means while said valve opening/closing control means opens an air valve supplying external air to said capping means at a fifth time after said fourth time and while ink is prevented from flowing to all of said nozzle openings.

9. A recording head cleaning method in an ink jet recording apparatus having an ink jet recording head for discharging ink droplets upon receiving ink supply from an ink cartridge, capping means for sealing said recording head to absorb ink through nozzle openings in said recording head, and a valve unit arranged between said ink cartridge and said nozzle openings of the recording head for opening and closing the ink supply path between the ink cartridge and the nozzle openings, the recording head cleaning method comprising:

(a) sealing the nozzle openings of the recording head with said capping means in a state closing said valve unit and applying negative pressure into the capping means;

(b) while applying said negative pressure into the capping means in said operation (a), opening said valve unit to absorb ink from selected nozzle openings of the nozzle openings of the recording head, (c) after said operation (b), sealing the nozzle openings of the recording head with said capping means in said state closing said valve unit and applying negative pressure into the capping means, and (d) while applying said negative pressure into the capping means in said operation (c), opening an air valve to supply external air to said capping means.

10. A recording head cleaning method as claimed in claim 9, wherein said operation (d) prevents air bubbles formed with discharged ink within the capping means from being pulled into the nozzle openings of the recording head.

11. A recording head cleaning method in an ink jet recording apparatus having an ink jet recording head including nozzle openings for discharging different color ink droplets through said nozzle openings upon receiving ink from ink cartridges, capping means for sealing each nozzle opening of said recording head to absorb ink through the nozzle openings, and a plurality of valve units arranged between said ink cartridges and each nozzle opening of the recording head for opening and closing ink supply paths between the ink cartridges and the nozzle openings, the recording head cleaning method comprising:

(a) sealing the nozzle openings of the recording head with said capping means in a state closing said valve units and applying negative pressure into the capping means;

(b) while applying said negative pressure into the capping means in said operation (a), opening all or a part of said valve units to absorb ink through selected nozzle openings of the nozzle openings of the recording head, (c) after said operation (b), sealing the nozzle openings of the recording head with said capping means in said state closing said valve units and applying negative pressure into the capping means, and (d) while applying said negative pressure into the capping means in said operation (c), opening an air valve to supply external air to said capping means.

12. A recording head cleaning method as claimed in claim 11, wherein said operation (d) prevents air bubbles formed with discharged ink within the capping means from being pulled into the nozzle openings of the recording head.

* * * * *

UNITED STATES PATENT AND TRADEMARK OFFICE

CERTIFICATE OF CORRECTION

PATENT NO. : 6,481,824 B1 
DATED : November 19, 2002
INVENTOR(S) : Hitoshi Hayakawa and Uwai, Hikonosuke It is certified that error appears in the above-identified patent and that said Letters Patent is hereby corrected as shown below:

Title page,
Item [30], Foreign Application Priority, please delete
"Jun 3, 1998 (JP) 10-18657 and
Jun 3, 1998 (JP) 10-35852"

Signed and Sealed this

Twenty-fourth Day of August, 2004

JON W. DUDAS
*Director of the United States Patent and Trademark Office*